US006966283B2

(12) United States Patent
Beshore

(10) Patent No.: US 6,966,283 B2
(45) Date of Patent: Nov. 22, 2005

(54) APPARATUS WITH PISTON HAVING UPPER PISTON EXTENSIONS

(76) Inventor: Craig S. Beshore, 753 Puma Canyon La., Glendora, CA (US) 91740

( * ) Notice: Subject to any disclaimer, the term of this patent is extended or adjusted under 35 U.S.C. 154(b) by 7 days.

(21) Appl. No.: 10/804,351

(22) Filed: Mar. 17, 2004

(65) Prior Publication Data

US 2005/0205025 A1 Sep. 22, 2005

(51) Int. Cl.[7] ..... F02B 75/02

(52) U.S. Cl. ..... 123/65 R; 123/66; 123/71 V; 417/261; 417/460

(58) Field of Search ..... 123/65 R, 66, 123/67, 68, 69 R, 69 V, 70 R, 70 V, 71 R, 123/71 V; 417/261, 460, 525

(56) References Cited

U.S. PATENT DOCUMENTS

| | | | |
|---|---|---|---|
| 621,916 | A | 3/1899 | Gately |
| 1,133,896 | A | 3/1915 | Van Houte, Jr. |
| 1,281,669 | A | 2/1918 | Sawyer |
| 1,270,295 | A | 6/1918 | Husted |
| 1,273,728 | A | 7/1918 | Burd et al. |
| 1,329,514 | A | 2/1920 | Desoevoir et al. |
| 1,360,690 | A | 3/1920 | Sawyer |
| 2,067,171 | A | 1/1937 | Beard |
| 2,458,672 | A | 1/1949 | Zoch, Jr. |
| 3,181,516 | A | 5/1965 | Peterson |
| 3,749,066 | A | 7/1973 | Cseh |
| 3,910,242 | A | 10/1975 | Hom et al. |
| 4,261,303 | A | 4/1981 | Ramsey |
| 4,586,881 | A | 5/1986 | Beshore |
| 4,625,685 | A | 12/1986 | Beshore |
| 6,145,488 | A | 11/2000 | Plechner |

*Primary Examiner*—Noah P. Kamen
(74) *Attorney, Agent, or Firm*—Sheldon & Mak; Denton L. Anderson

(57) ABSTRACT

An apparatus useful in a two-stroke cycle engine or in a pump as a piston disposed within a piston cylinder. The piston cylinder has an intermediate piston cylinder head disposed transversely across the interior of the piston cylinder. The piston has a lower portion and at least one upright extension member extending upwardly from the lower portion. The upright extension member extends upwardly into the upper portion of the piston cylinder through a gap between the intermediate piston cylinder head and the piston cylinder wall. A piston top wall is disposed transversely to the piston cylinder side wall and is attached to the upper portion of the upright extension member of the piston. An upper piston cylinder chamber is defined above the piston top wall. An intermediate piston cylinder chamber is defined immediately below the piston top wall and a piston cylinder lower chamber is defined below the intermediate piston cylinder head.

21 Claims, 17 Drawing Sheets

APPARATUS WITH PISTON HAVING UPPER PISTON EXTENSIONS

FIELD OF THE INVENTION

This invention relates generally to piston driven apparatuses, such as pumps and engines. In one specific embodiment, the invention relates to two-stroke cycle engines.

BACKGROUND OF THE INVENTION

Crank case scavenged, cylinder ported two-stroke cycle engines of the prior art are commonly used for a wide variety of light duty applications. Two-stroke cycle engines of the prior art, however, have several shortcomings.

One shortcoming arises from the fact that prior art two-stroke cycle engines typically have intake and exhaust ports at about the same level. This results in some of the intake fuel-air mixture following the exhaust out of the exhaust port, thereby decreasing efficiency and increasing emissions.

Another shortcoming of prior art two-stroke engines arises because some of the engine's lubricating oil can pass to the exhaust port, thus producing emissions and often leaving deposits on the walls of the exhaust port, thus forming a hard carbon layer or "coking" which restricts the exhaust and causes other problems.

Yet another shortcoming of prior art two-stroke cycle engines involves the difficulty of bringing intake fuel-air mixture from the bottom of the engine cylinder to the top of the cylinder where the igniter is located. During part throttle operation, most of what remains in the cylinder are burnt gases. Moving the small amount of fresh intake mixture undiluted by burnt gases to the igniter becomes very problematic. Misfires are typical, resulting in irregular operation, and surging. Various arrangements, such as loop scavenging or deflecting pistons, have been suggested for passing the mixture to the combustion chamber without some of it escaping via the exhaust port. None of these various arrangements, however, have been wholly successful.

Yet another shortcoming of prior art two-stroke cycle engines involves the difficulty of lubricating the cylinder wall and piston. Having the piston pass over both intake and exhaust ports around the lower circumference of the cylinder limits the amount of oil that can be delivered to the upper cylinder wall. Piston thrust against the cylinder wall then results in scuffing and premature wear.

Yet another shortcoming of prior art two-stroke cycle engines involves the use of the crank case as the delivery pump for the scavenge charge. This results in delivery of the charge at very limited pressure, limiting control of the scavenge process. Mixing oil with the fuel or an expensive oiling system is also required, as are more expensive bearings that will survive on oil vapor only.

Fuel injection systems have been utilized in order to reduce emissions and to delay fuel injection until an exhaust port is closed. However, such systems are generally costly and often involve new problems.

For many years, efforts have been made to deliver a fresh fuel-air charge directly to a spark plug to insure ignition with every piston stroke. None of these efforts, however, have been truly successful.

Accordingly, there is a need for a two-stroke cycle engine which avoids the aforementioned problems in the prior art in an efficient and inexpensive manner.

SUMMARY

The invention satisfies this need. In a broadest sense, the invention is an apparatus suitable for use both in a two-stroke cycle engine and in a pump. The apparatus comprises: (a) a piston cylinder having a piston cylinder upper portion, a piston cylinder lower portion, an internal piston cylinder side wall and a piston cylinder top cover, the piston cylinder further having an intake port defined within the piston cylinder upper portion and an exhaust port defined within the piston cylinder lower portion; (b) an intermediate piston cylinder head, fixedly disposed within the piston cylinder so as to separate the piston cylinder upper portion from the piston cylinder lower portion, the piston cylinder head extending transversely across the interior of the piston cylinder and having an upper surface and a lower surface, the piston cylinder head being disposed within the cylinder so as to define at least one head gap between the piston cylinder internal side wall and the piston cylinder head; (c) a piston slidably disposed within the piston cylinder, the piston having an external piston side wall sized and dimensioned to be operatively sealable with the internal piston cylinder side wall, the piston also having a lower piston portion with a lower piston portion upper surface disposed within the lower piston cylinder portion and an upper piston portion comprising at least one upright extension member, the at least one upright extension member having an uppermost portion, the at least one upright extension member extending upwardly from the lower piston portion through the at least one head gap and being extendable upwardly into the upper cylinder portion, the lower piston portion upper surface being adapted to cooperate with the internal piston cylinder side wall and the lower surface of the piston cylinder head to define an enclosed lower chamber, the piston being operatively connected to a crank shaft by a piston rod and adapted to reciprocate within the piston cylinder between an upward cycle and a downward cycle; and (d) a piston top wall disposed transversely to the internal piston cylinder side wall and attached to the uppermost portion of the at least one upright extension member, the piston top wall being adapted to cooperate with the piston cylinder internal side wall to define an enclosed upper chamber in the upper cylinder portion immediately above the piston top wall, the piston top wall also being adapted to cooperate with the at least one upright extension member, the internal piston cylinder side wall and the upper surface of the piston cylinder head to form an enclosed intermediate chamber immediately below the piston top wall.

In one particular embodiment of the invention, wherein the invention is useful in a two-stroke cycle engine, the invention further comprises a valve for alternatively allowing the transfer of fluids into the intermediate chamber and for alternatively preventing the transfer of fluids from the intermediate chamber, means for alternatively allowing the transfer of fluids between the intermediate chamber and the lower chamber and an igniter disposed proximate to the lower chamber.

DRAWINGS

These and other features, aspects and advantages of the present invention will become better understood with reference to the following description, appended claims and accompanying drawings where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 27:
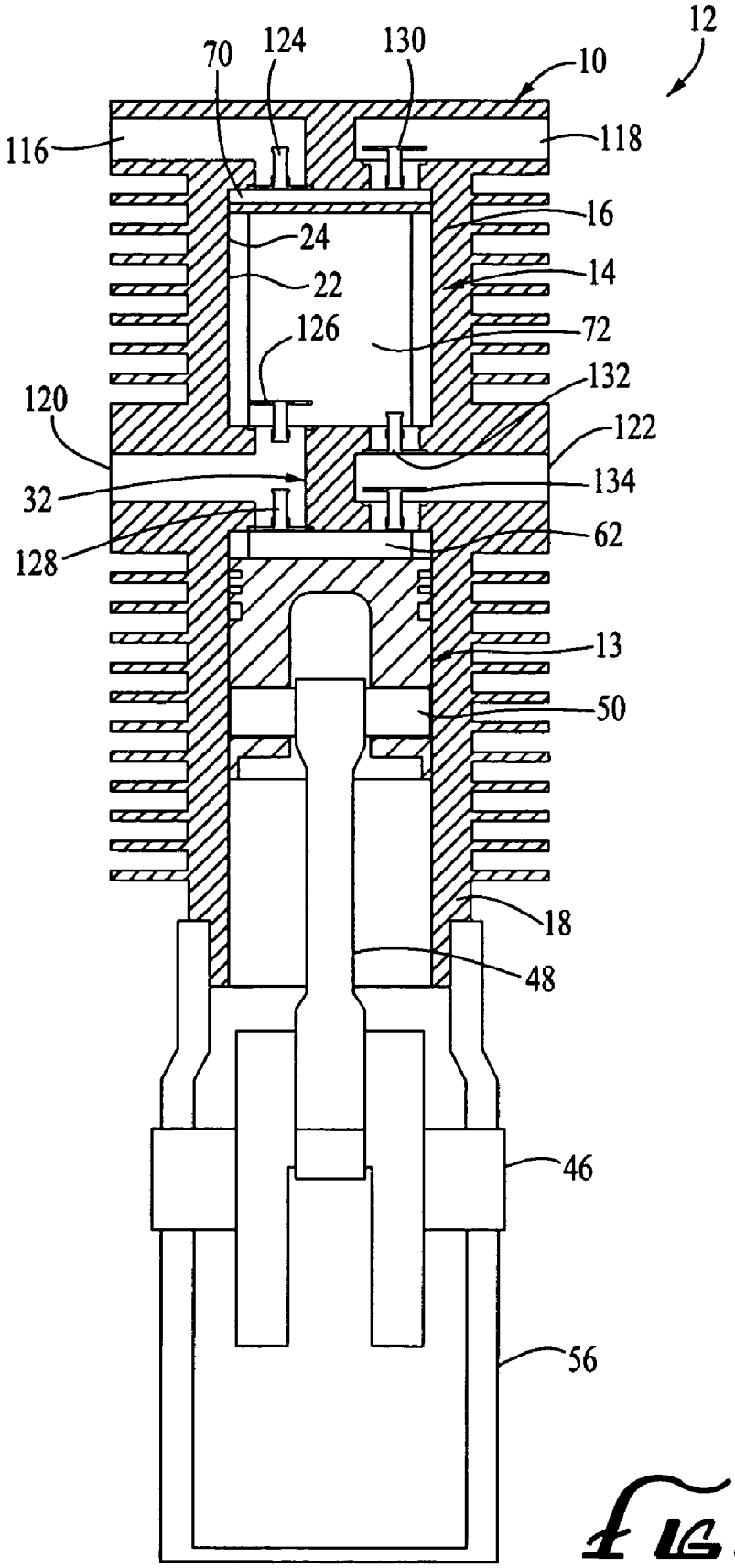
FIG. 27 is a cross-sectional side view of a fifth apparatus having features of the invention.
Figure 28:
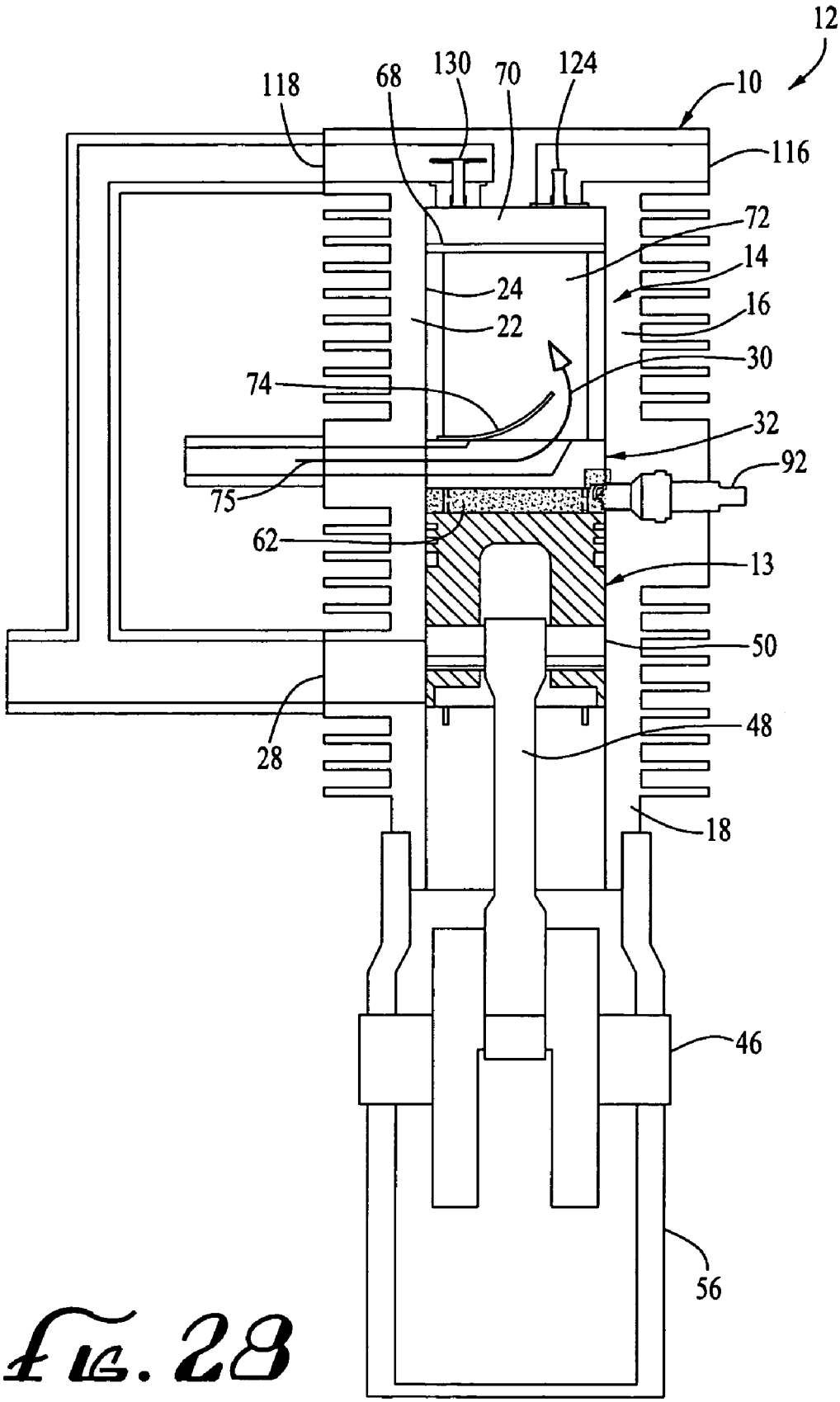
FIG. 28 is a cross-sectional side view of a sixth apparatus having features of the invention.

The invention is an apparatus 10 which can be useful in both a two-stroke cycle engine 11 or in a pump 12. FIGS. 1–26 illustrate the apparatus 10 as used in a two-stroke cycle engine 11. FIGS. 27 and 28 illustrate the apparatus 10 as used in a pump 12.

The invention comprises a uniquely configured piston 13 disposed within a uniquely configured piston cylinder 14. The piston cylinder 14 has a piston cylinder upper portion 16, a piston cylinder lower portion 18 and a piston cylinder top cover 20. The piston cylinder 14 further comprises one or more piston cylinder side walls 22, each having an interior surface 24.

In the embodiments wherein the apparatus 10 is used in a two-stroke cycle engine 11, at least one intake port 26 is defined within the piston cylinder upper portion 16 and at least one exhaust port 28 is defined within the piston cylinder lower portion 18. The intake port 26 is adapted to emit a fuel-air mixture 30 into the upper portion 16 of the piston cylinder 14, such as via a carburetor or fuel injector (not shown).

An intermediate piston cylinder head 32 is fixedly disposed within the piston cylinder 14 so as to separate the piston cylinder upper portion 16 from the piston cylinder lower portion 18. The piston cylinder head 32 extends transversely across the interior of the piston cylinder 14 and has an upper surface 34, a lower surface 36 and side walls 38.

The piston cylinder head 32 can be fixedly mounted in the piston cylinder 14 by any suitable method, such as by welding, force fit, or being formed integrally within the piston cylinder 14. A resilient seal 40 is optionally provided between the piston cylinder head 32 and the interior wall of each piston upright extension member 66 (described below).

The piston cylinder head 32 is disposed within the piston cylinder 14 so as to define at least one head gap 42 between the piston cylinder side wall 22 and the piston cylinder head 32. In the embodiments illustrated in the drawings, the piston cylinder head 32 has a pair of opposed flat side walls 38, so as to define a pair of opposed head gaps 42.

Also in the embodiment illustrated in the drawings, the cylinder has a plurality of cooling fins 44 disposed about its exterior. Alternatively, the cooling fins 44 can be eliminated and interior passageways can be provided for liquid cooling.

The piston 13 is slidably disposed within the piston cylinder 14. The piston 13 is operatively connected to a crank shaft 46 by a piston rod 48 and is adapted to reciprocate within the piston cylinder 14 between an upward cycle and a downward cycle. A crank pin 50 is rotatably mounted in the lower portion 59 of the piston 13. The piston rod 48 has its upper portion disposed about the crank pin 50 and extends to engage a conventional crankshaft 46 disposed within a conventional crank case 56.

Figure 1:
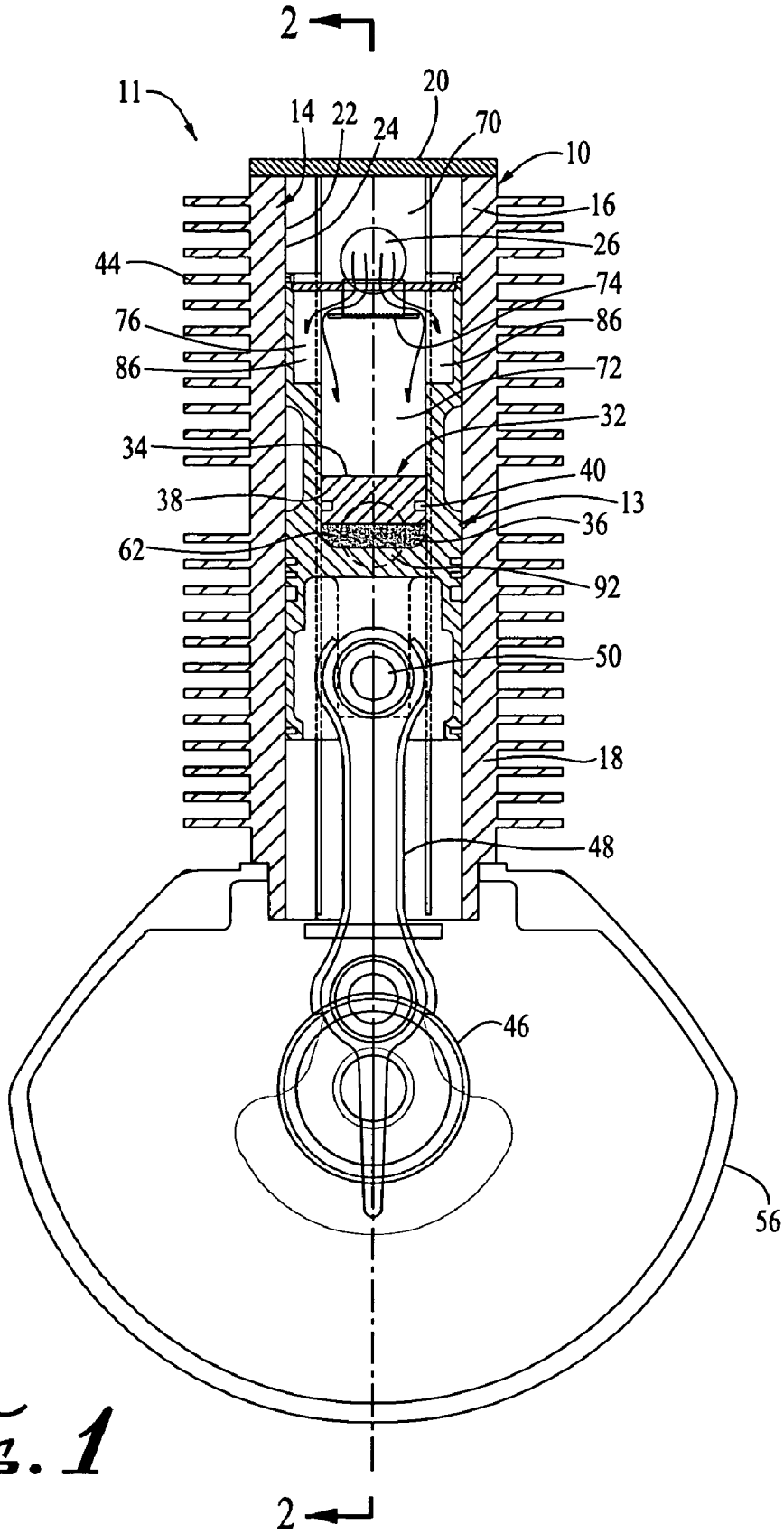
FIG. 1 is a cross-sectional view of a first apparatus having features of the invention.
Figure 2:
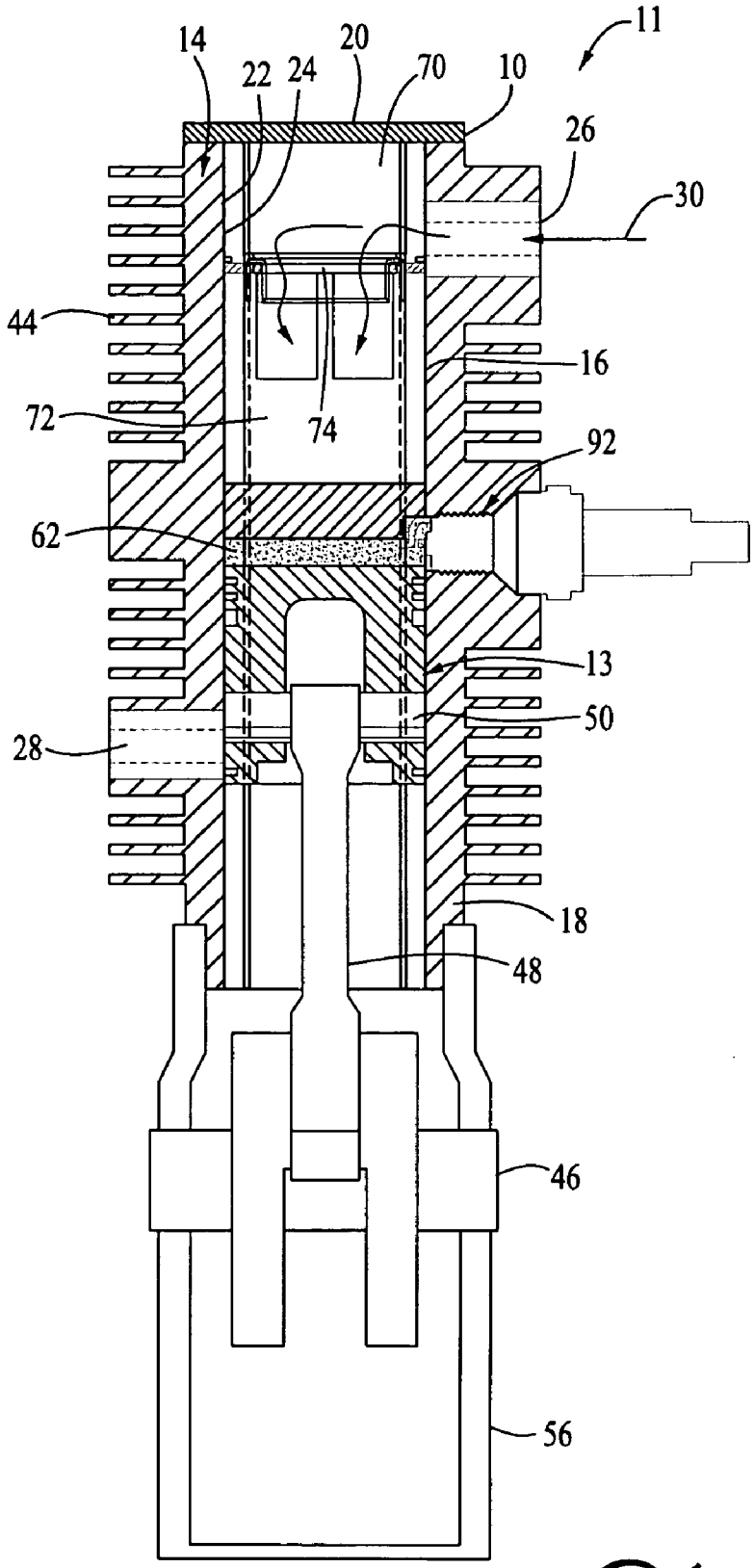
FIG. 2 is a cross-sectional of the apparatus illustrated in FIG. 1, taken along line 2—2.
Figure 3:
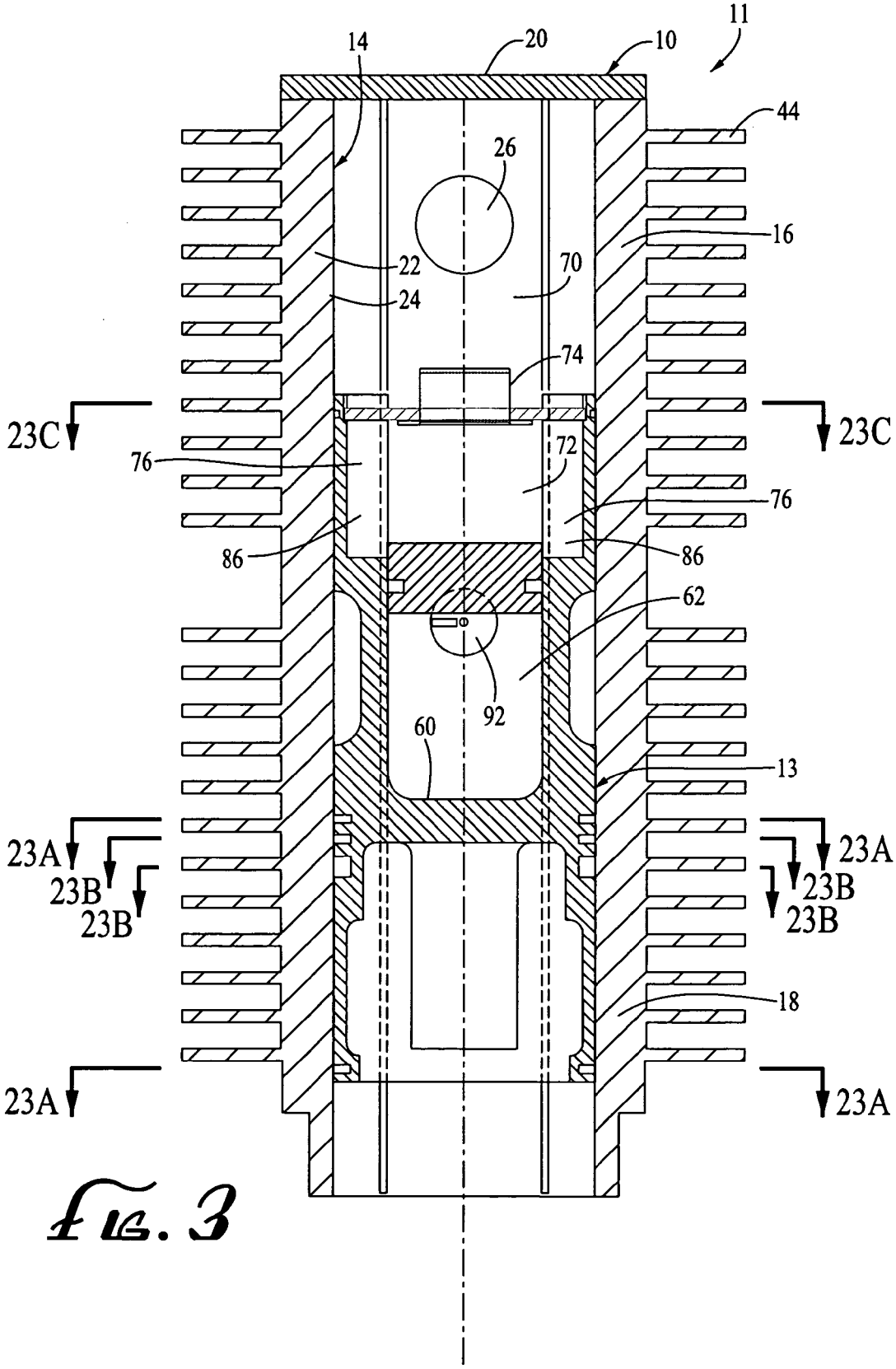
FIG. 3 is another cross-sectional view of the apparatus illustrated in FIG. 1, showing the piston in a different position.
Figure 5:
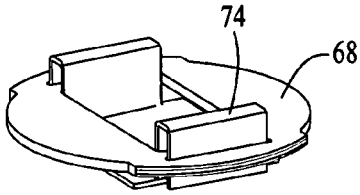
FIG. 5 is a perspective view of a piston top wall valve useful in the apparatus.
Figure 4:
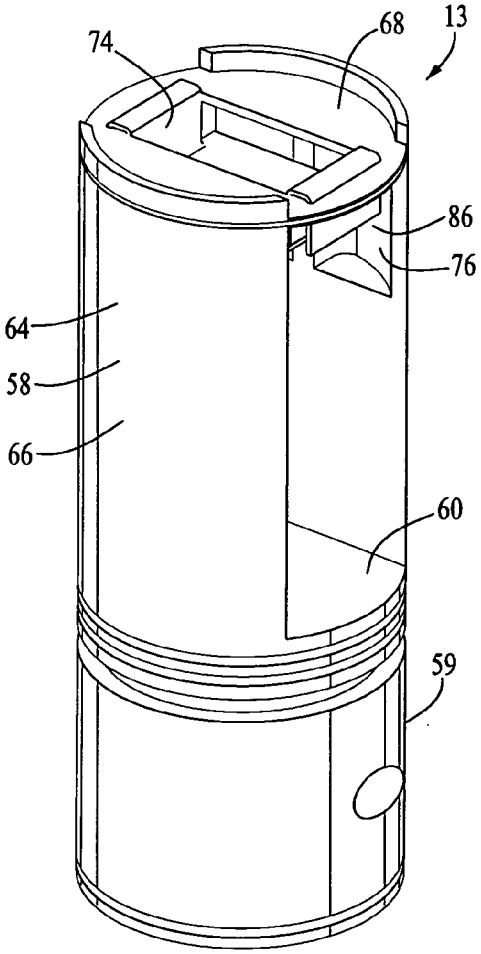
FIG. 4 is a perspective view of the piston component of the apparatus illustrated in FIG. 1.
Figure 6:
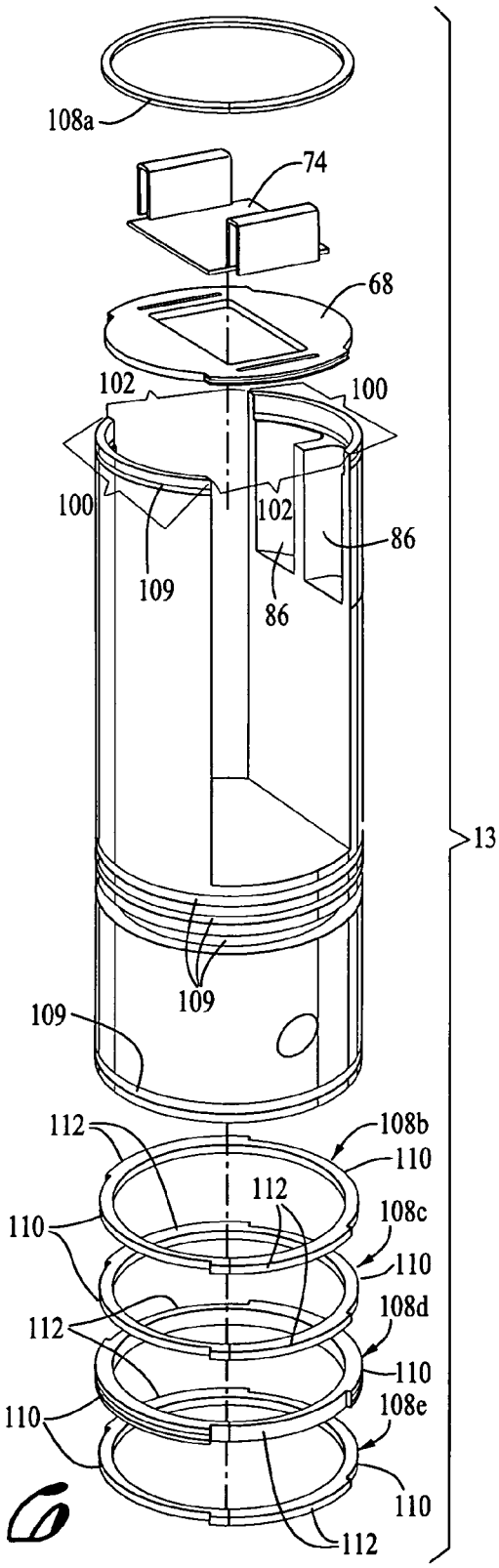
FIG. 6 is an exploded perspective view of the piston and associated components illustrated in FIG. 4.

The piston 13 is best visualized in FIGS. 4, 5 and 6. The piston 13 has at least one exterior piston side wall 58. The at least one exterior piston side wall 58 is sized and dimensioned to be operatively sealable with the interior surface 24 of the at least one piston cylinder side wall 22.

The piston 13 has a lower piston portion 59 disposed within the lower piston cylinder portion. The lower piston portion has an upper surface 60 which is adapted to cooperate with the interior surface 24 of the piston cylinder side wall 22, the upright extension members 66 and the lower surface 36 of the piston cylinder head 32 to define an enclosed lower chamber 62. Where the apparatus 10 is used in a two-stroke cycle engine 11, the lower chamber 62 serves as a combustion chamber.

The piston 13 also has an upper piston portion 64 which comprises at least one upright extension member 66. The at least one upright extension member 66 extends upwardly from the lower piston portion 59, through the at least one head gap 42 and is extendable upwardly into the piston cylinder upper portion 16.

In the embodiments illustrated in the drawings, the at least one upright extension member 66 comprises a pair of opposed upright extension members 66. In such embodiments, the piston cylinder head 32 is disposed within the piston cylinder 14 so as to define a pair of opposed head gaps 42 between the interior surface 24 of the piston cylinder side wall 22 and the piston cylinder head 32. Each of the pair of opposed upright extension members 66 extends upwardly from the piston lower portion 59 through one of the two opposed head gaps 42, and is extendable into the piston cylinder upper portion 16.

A piston top wall 68 is disposed transversely within the piston cylinder 14 and is attached to the uppermost portion of the at least one upright extension member 66. The piston top wall 68 is adapted to cooperate with the interior surface 24 of the piston cylinder side wall 22 to define an enclosed upper chamber 70 in the piston cylinder upper portion 16 immediately above the piston top wall 68. Where the apparatus 10 is used in a two-stroke cycle engine 11, the upper chamber 70 serves as an intake manifold.

The piston top wall 68 is also adapted to cooperate with the at least one upright extension member 66, the interior surface 24 of the piston cylinder side wall 22 and the upper surface 34 of the piston cylinder head 32 to form an enclosed intermediate chamber 72. Where the apparatus 10 is used in a two-stroke cycle engine 11, the intermediate chamber 72 serves as an scavenge passage.

A valve 74 is provided within the piston cylinder 14 for alternatively allowing the transfer of fluids into the intermediate chamber 72 and for alternatively preventing the transfer of fluids from the intermediate chamber 72.

Figure 7:
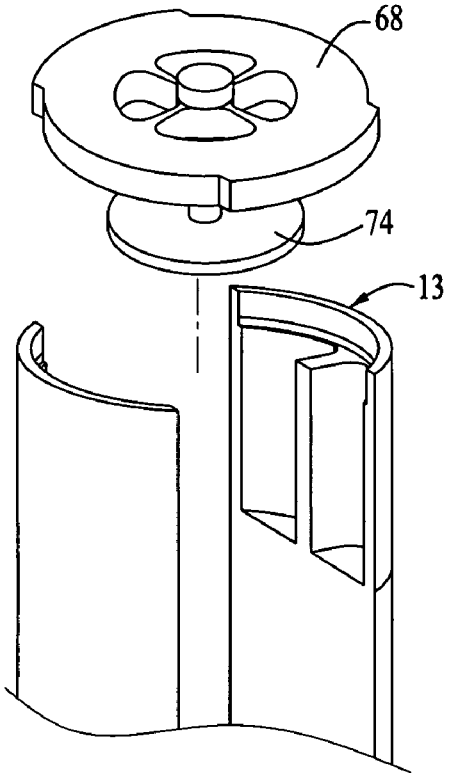
FIG. 7 is an exploded perspective view showing a first alternative piston top wall valve useful in the apparatus.
Figure 8:
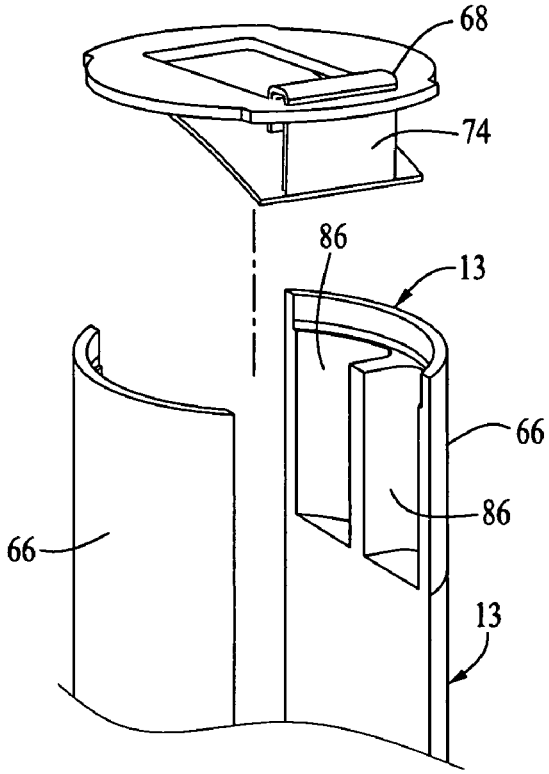
FIG. 8 is an exploded perspective view showing a second alternative piston top wall valve useful in the apparatus.

In the embodiment illustrated in FIGS. 1–8, the valve 74 is an inertial valve disposed within the piston top wall 68. The inertial valve 74 is adapted to open on the downward cycle of the piston 13 by inertial and pressure forces and close on the upward cycle of the piston 13 by reverse inertial and pressure forces. FIGS. 5 and 6 illustrate a first inertial valve 74 useful in the invention. FIGS. 7 and 8 illustrate two alternative inertial valves 74 useful in the invention.

Figure 9:
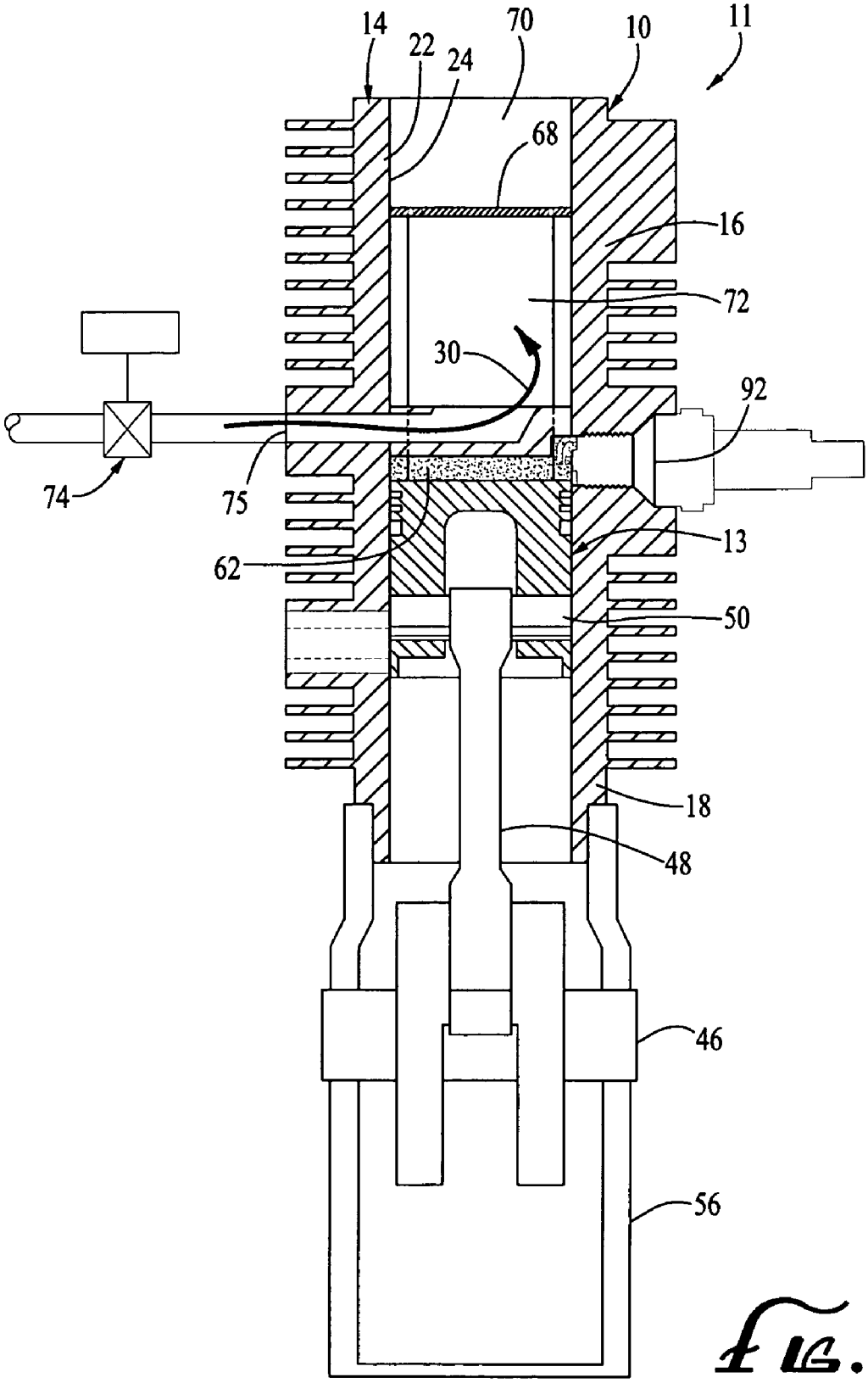
FIG. 9 is a cross-sectional view of a second apparatus having features of the invention.

In the embodiments illustrated in FIGS. 9 and 28, the valve 74 is an external valve 74, typically a mechanical or electromechanical valve 74 (FIG. 9), or a flap or reed valve 74 (FIG. 28). In both cases, the valve 74 controls the flow of fluids injected directly into the intermediate chamber 72 via a passage 75 which runs through the cylinder side wall 22. Where the valve 74 is a flap or reed valve, the valve 74 is opened by the flow of incoming fluids during the upward cycle of the piston 13, and is closed by pressure within the intermediate chamber 72 during the downward cycle of the piston 13.

Figure 10:
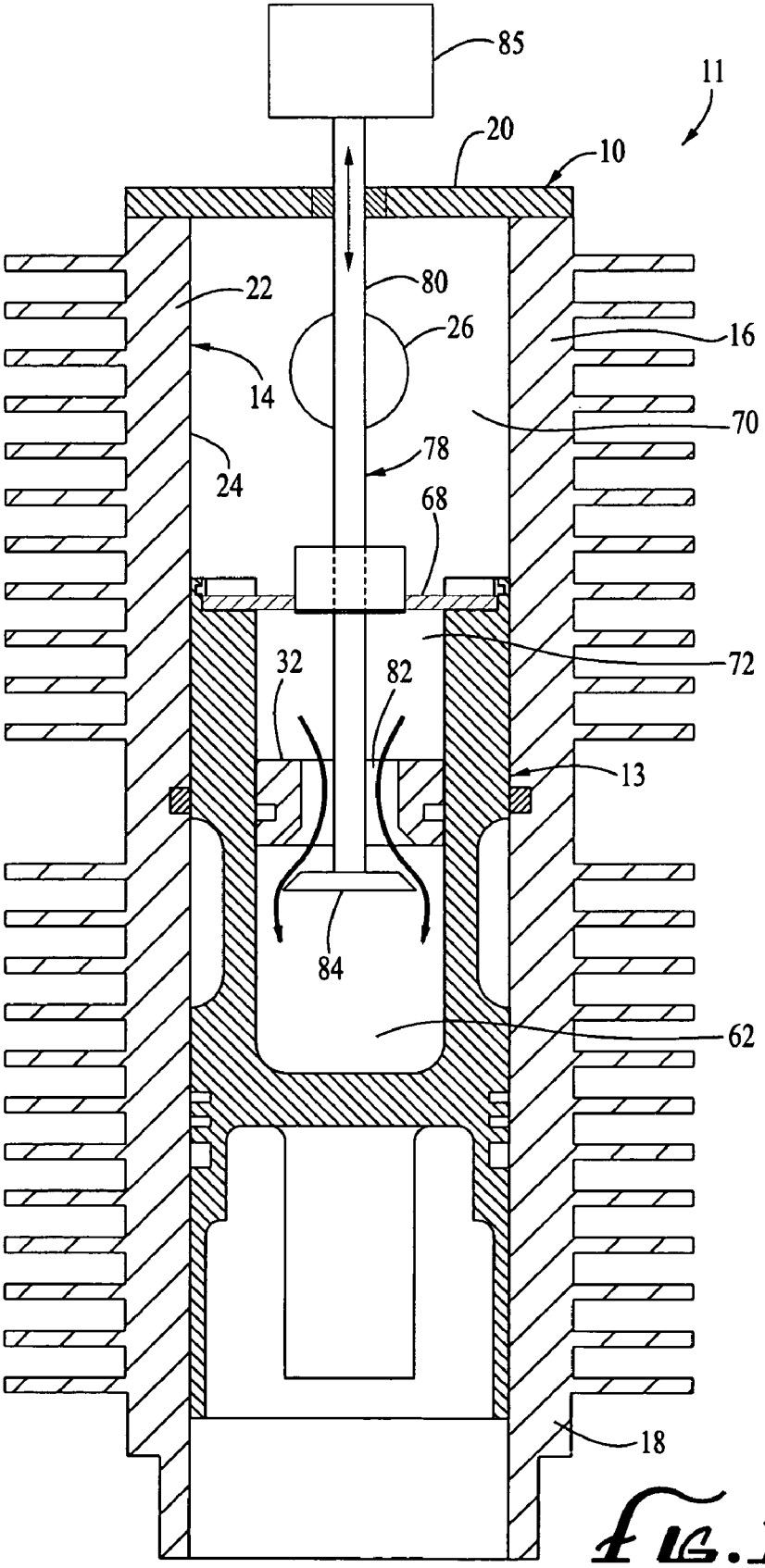
FIG. 10 is a cross-sectional view of a third apparatus having features of the invention.
Figure 11:
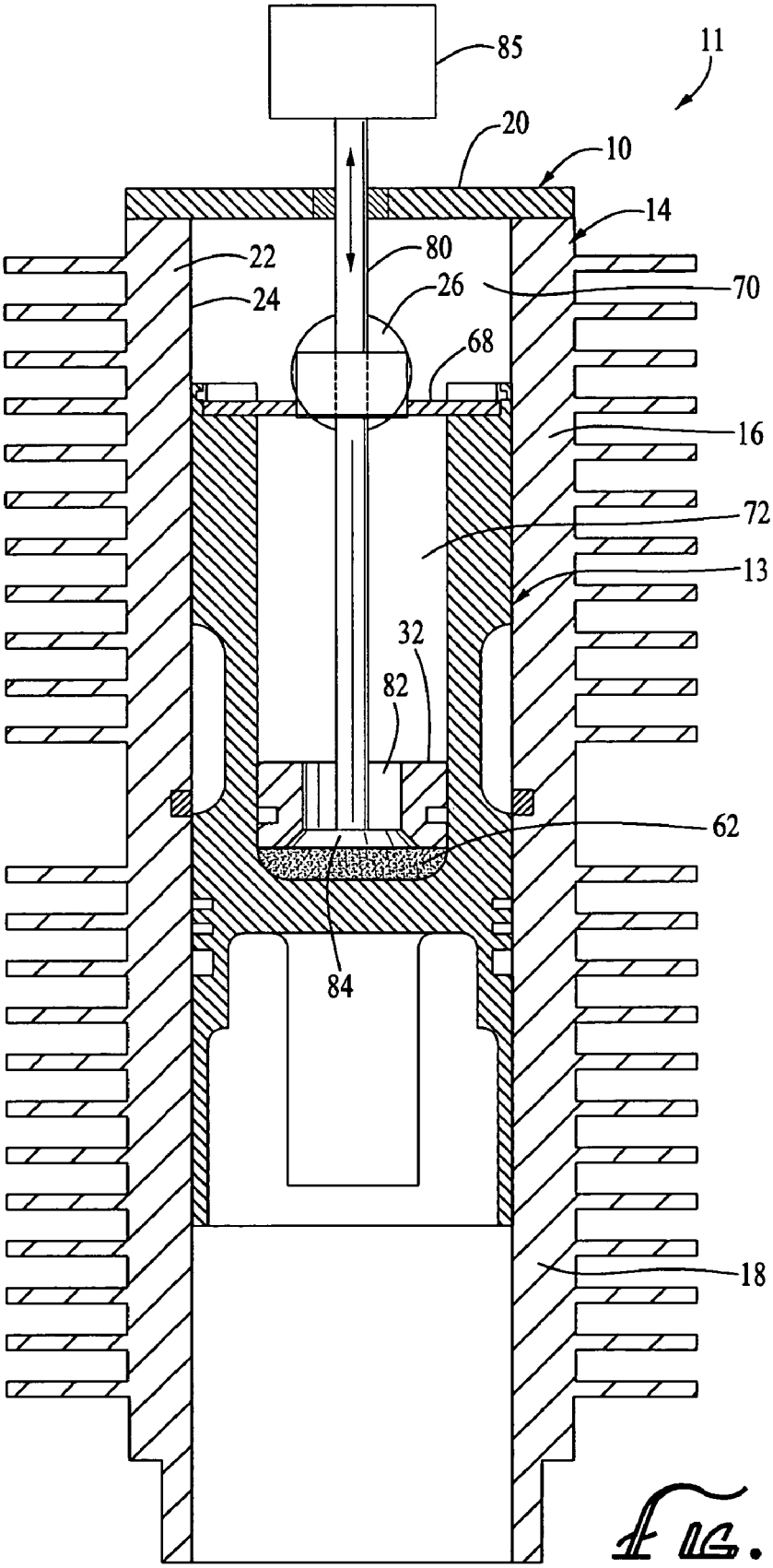
FIG. 11 is another cross-sectional view of the apparatus illustrated in FIG. 10, showing the valve in a closed position.
Figure 12:
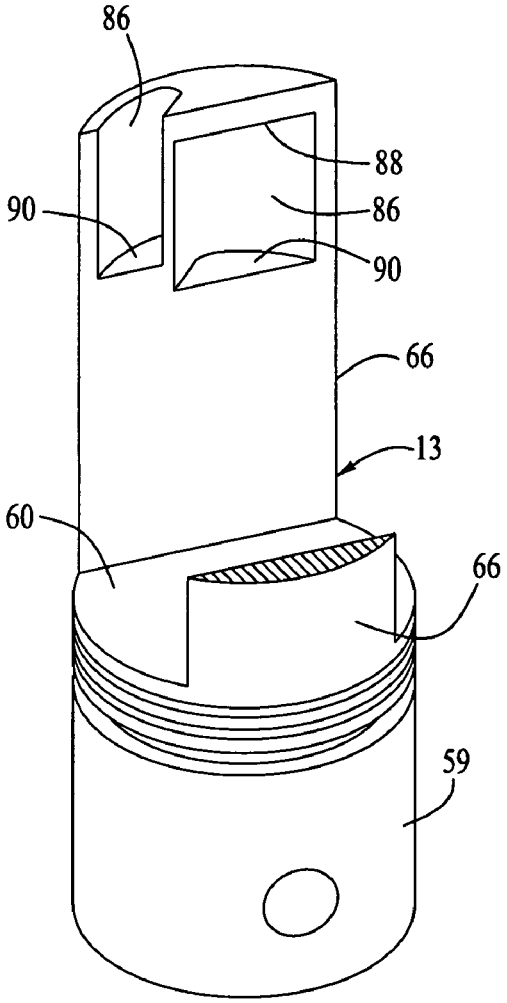
FIG. 12 is a cutaway perspective view of a piston having features of the invention and showing an upright extension member.
Figure 13:
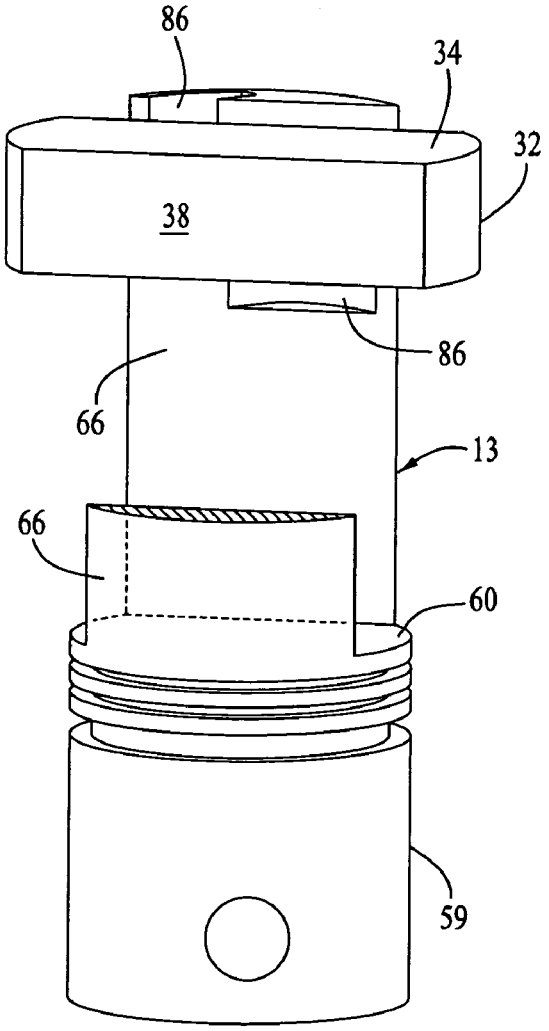
FIG. 13 is another cutaway view of a piston having features of the invention, and showing an piston cylinder head component relative to an upright extension member.
Figure 14:
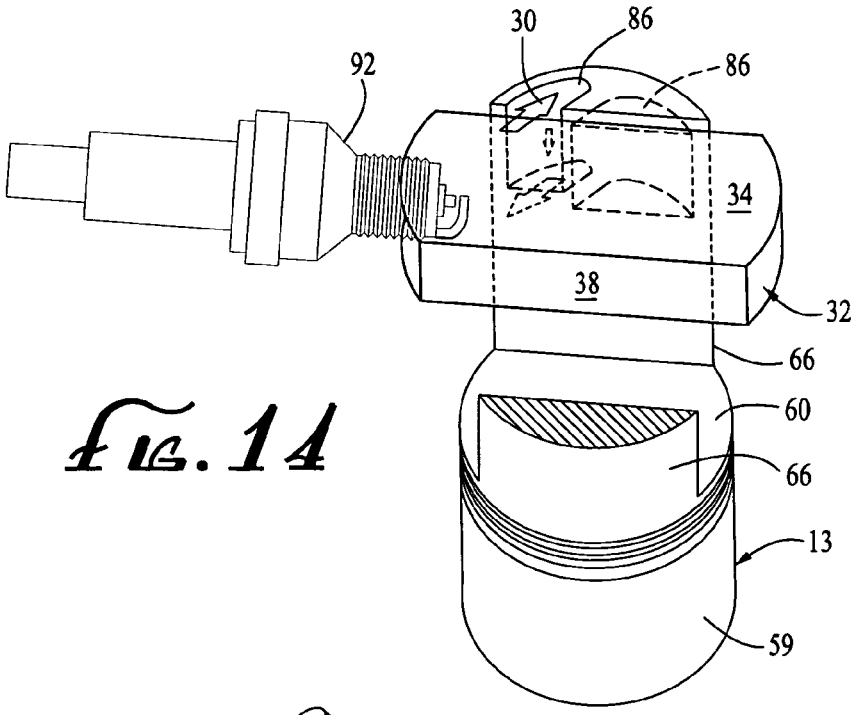
FIGS. 14 and 15 are cutaway perspective views of a piston upright extension member in relationship to an piston cylinder head member.

Means 76 are also provided for alternatively allowing the transfer of fluids between the intermediate chamber 72 and the lower chamber 62 and for alternatively preventing the transfer of fluids between the intermediate chamber 72 and the lower chamber 62. In one embodiment, such means 76 are provided by a valve 78. FIGS. 10 and 11 illustrate such an embodiment. The valve 78 is a poppet valve having an elongated valve rod 80 which extends through the piston cylinder top cover 20, through a valve opening 81 in the piston top wall 68 and through an enlarged passage 82 in the piston cylinder head. A disc 84 is disposed at the end of the valve rod 80. The poppet valve may be operated for upward and downward travel by various means 76, typically by an electromechanical actuator 85. The poppet valve is movable to its lower position, as illustrated in FIG. 10, wherein the disc member is spaced apart from the passage 82 in the piston cylinder head 32. With the poppet valve in the upper position, as illustrated in FIG. 11, the passage 82 in the piston top wall 68 is sealed closed by the poppet valve, thus to retain fuel-air mixture 30 in the lower chamber 62.

The means 76 for alternatively allowing the transfer of fluids between the intermediate chamber 72 and the lower chamber is alternatively provided by at least one scavenge passage 86 disposed within the at least one upright extension member 66. During a portion of both the upward and downward cycles of the piston 13, the scavenge passages 86 are open to both the intermediate chamber 72 and the lower chamber 62. Thus, during the downward cycle of the piston 13, the piston 13 compresses fluids in the intermediate chamber 72 between the piston cylinder head 32 and the piston top wall 68. Upon such compression, the fluids within the intermediate chamber 72 are forced into the lower chamber 62 via the scavenge passages 86.

In the embodiment illustrated in FIGS. 1–9, 12–16 and 23–26, each of the pair of upright extension members 66 comprises a plurality of scavenge passages 86. In the embodiment illustrated in these drawings, some of the scavenge passages 86 in each of the pair of upright extension members 66 have a top wall 88, and some of the scavenge passages 86 in each of the pair of upright extension members 66 do not have a top wall 88. The scavenge passages 86 which have a top wall 88 also have a bottom wall 90 which is disposed at a lower elevation than the bottom wall 90 of the scavenge passages 86 which have no top wall 88. Many other scavenge passage configurations are possible.

Figure 15:
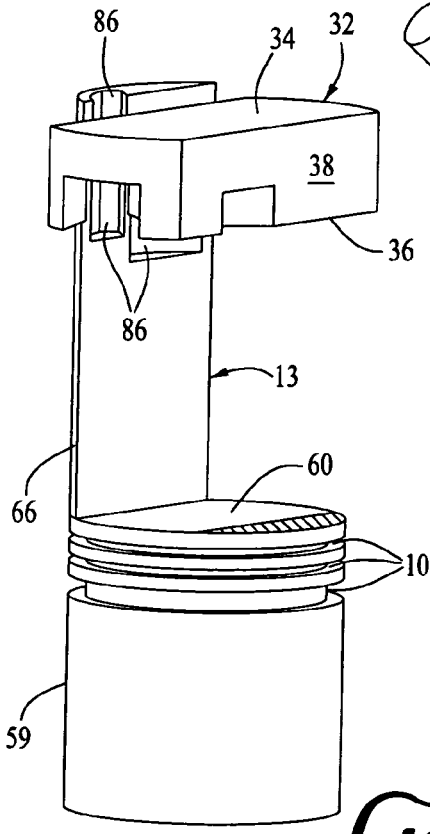
Figure 16:
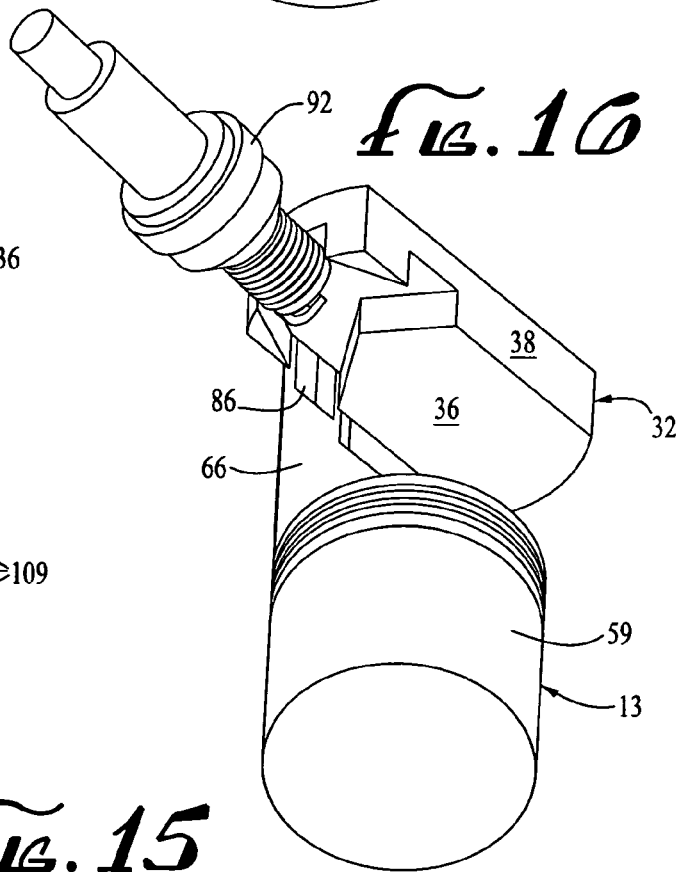
FIG. 16 is a perspective view of an piston cylinder head member in relation to a spark plug.
Figure 17:
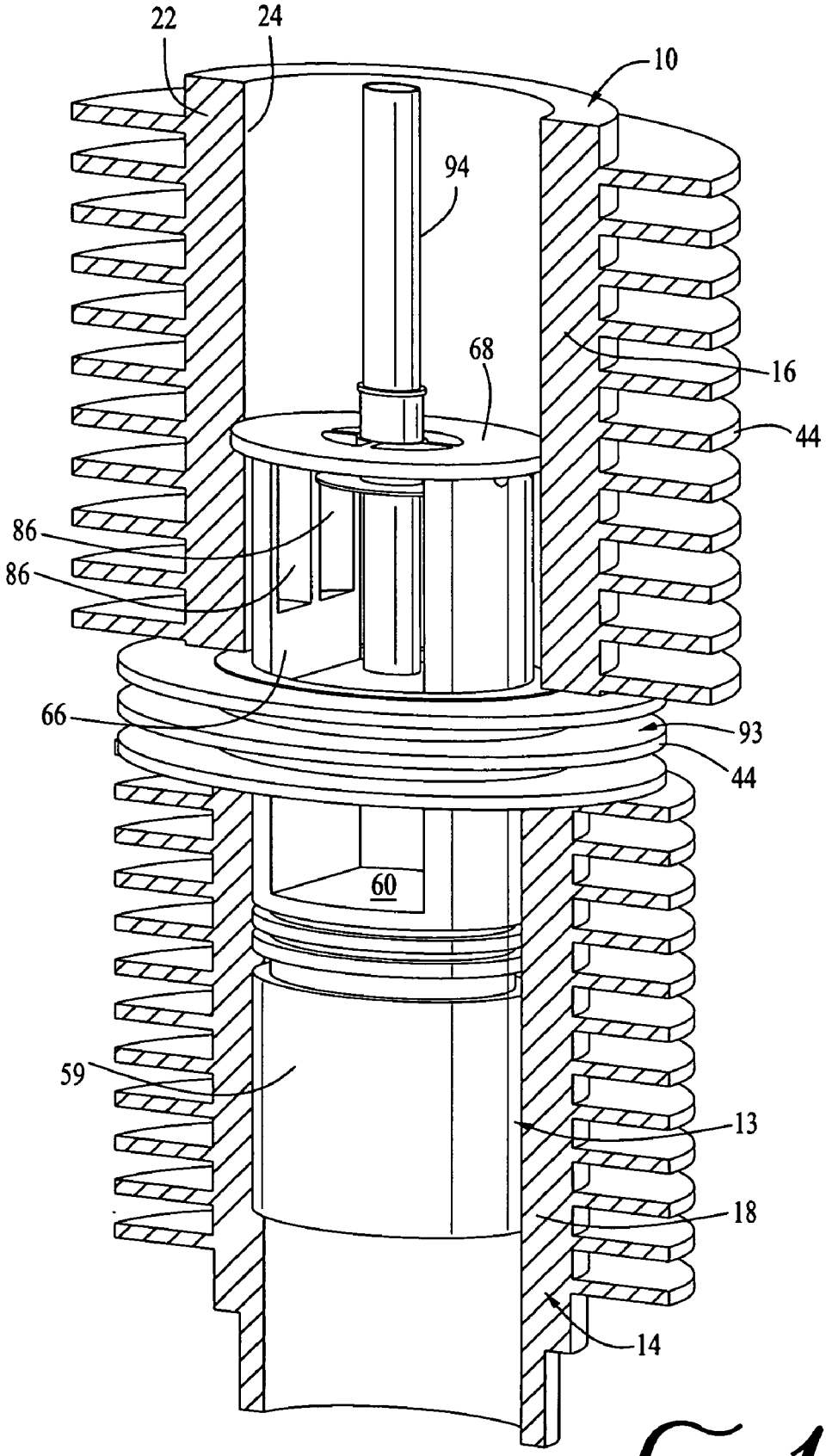
FIG. 17 is a cross-sectional perspective view of a fourth apparatus having features of the invention.
Figure 18:
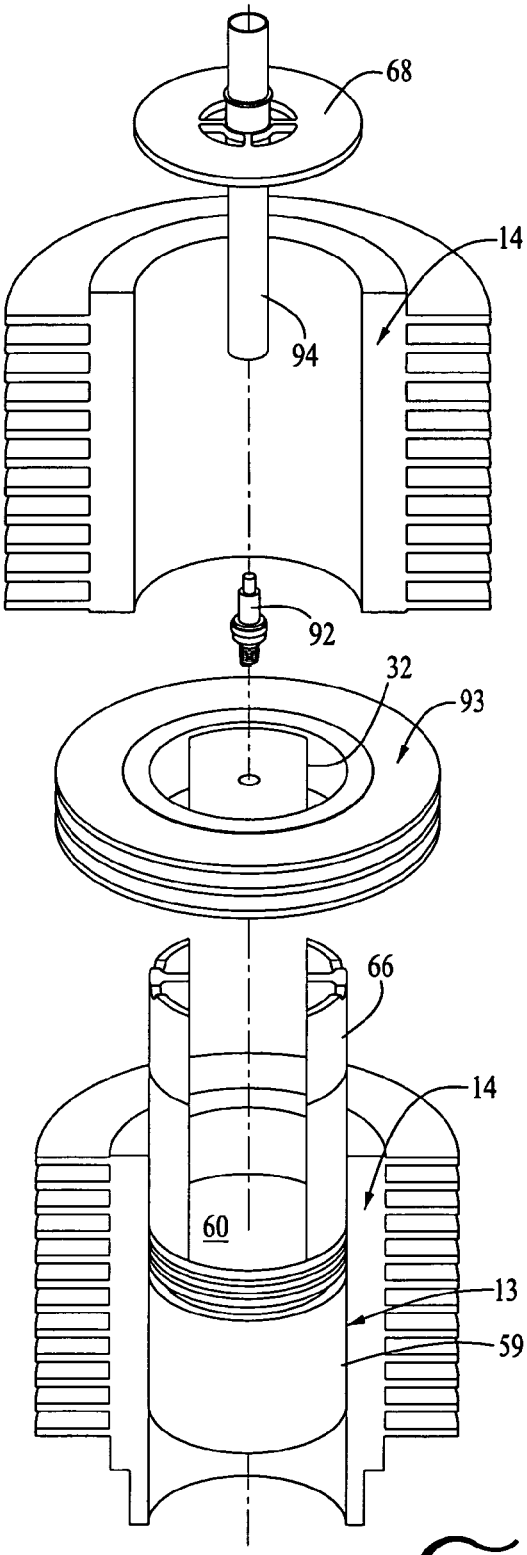
FIG. 18 is a first exploded view of the apparatus illustrated in FIG. 17.
Figure 19:
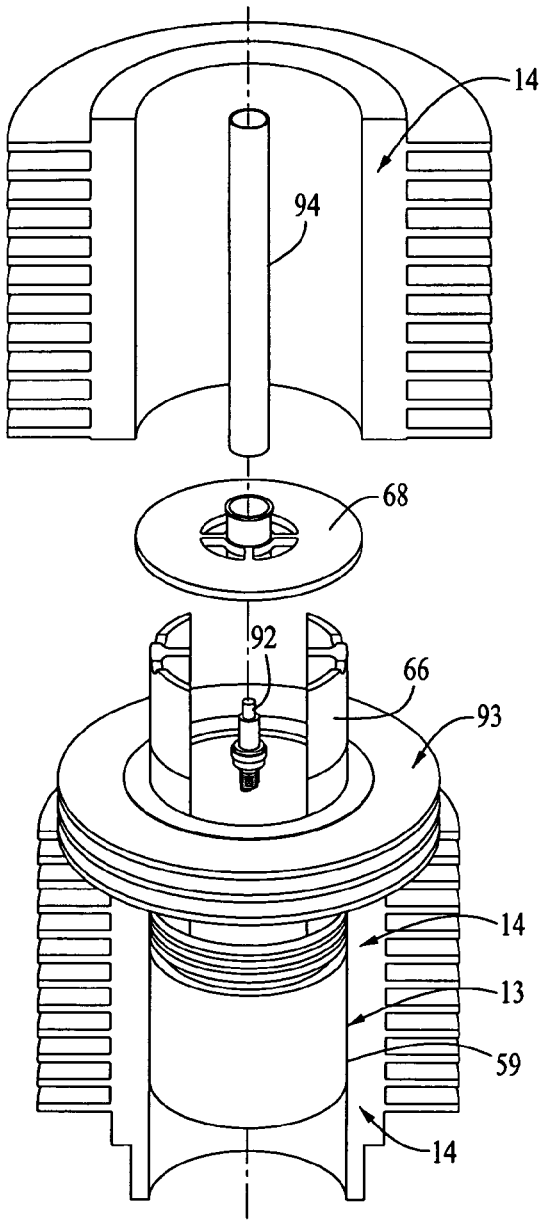
FIG. 19 is a second exploded view of the apparatus illustrated in FIG. 17.
Figure 20:
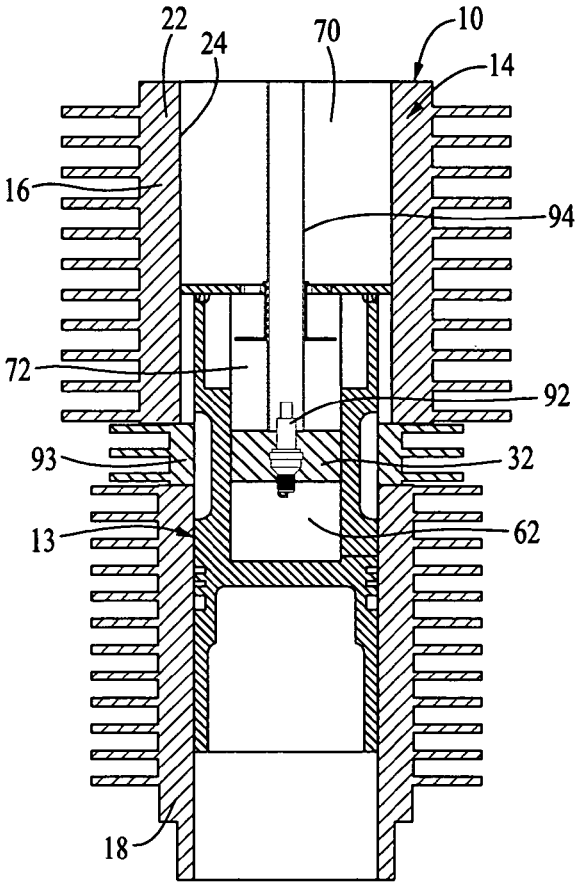
FIG. 20 is a first cross-sectional side view of the apparatus illustrated in FIG. 17.
Figure 21:
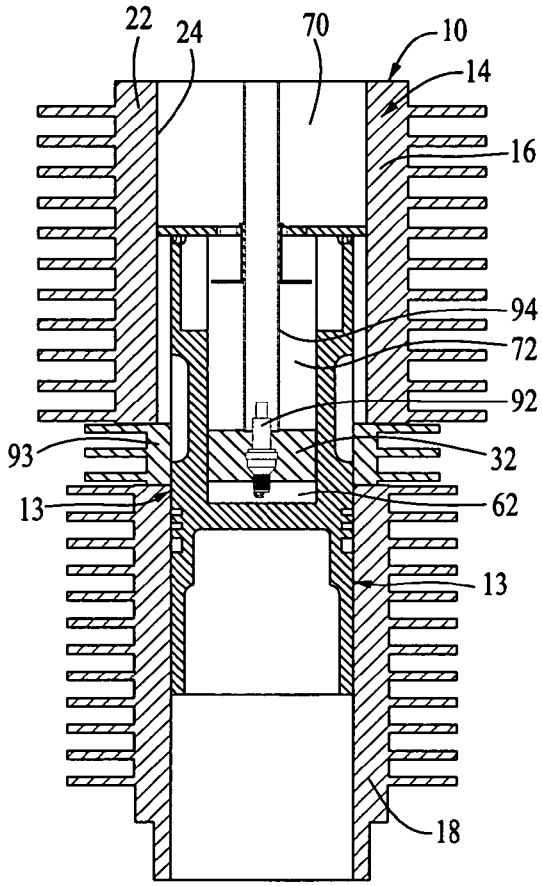
FIG. 21 is a second cross-sectional side view of the apparatus illustrated in FIG. 17.
Figure 22:
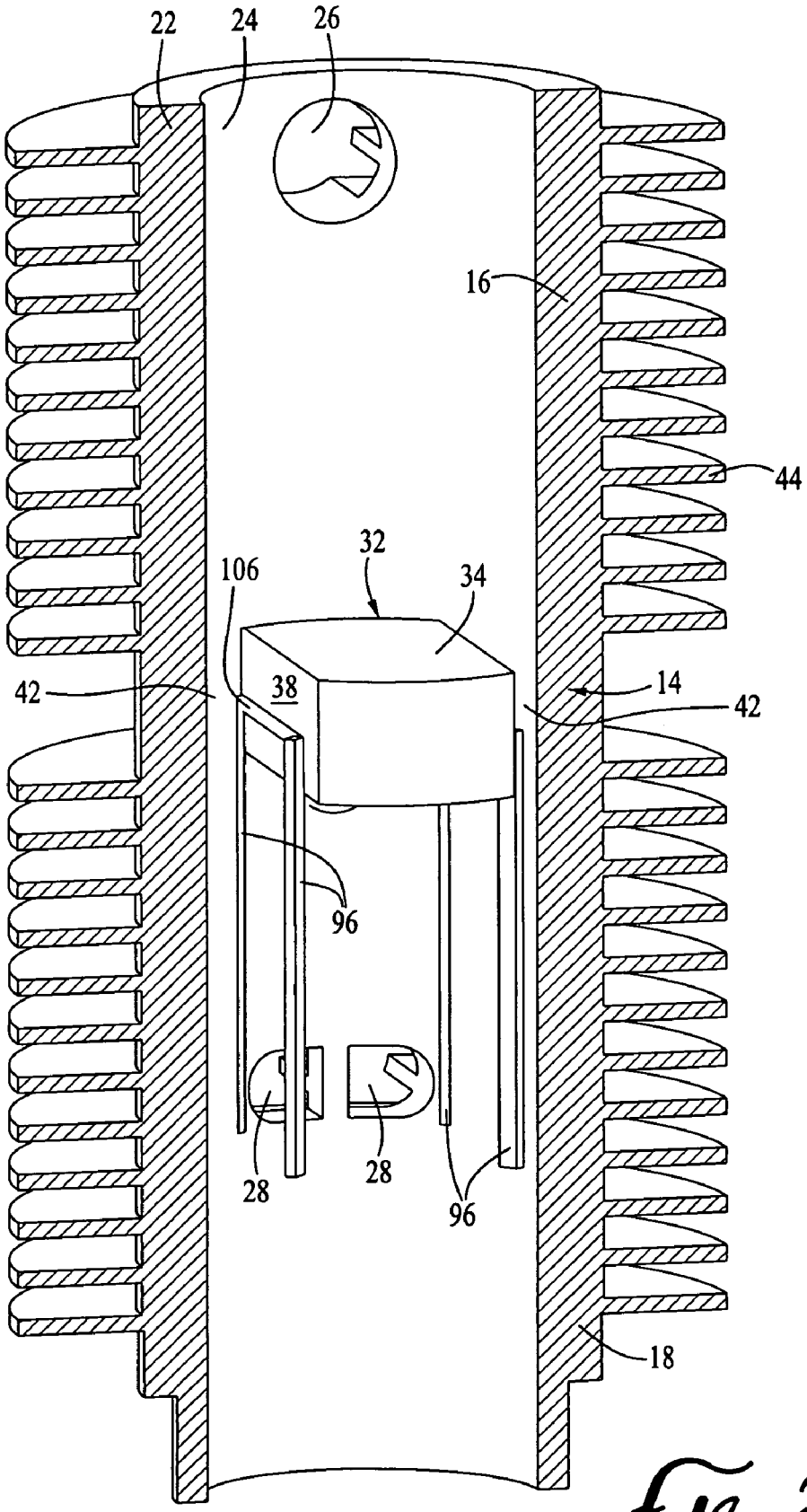
FIG. 22 is a cross-sectional perspective view of an apparatus having features of the invention illustrating the disposition of seal strips relative to the interior of the piston cylinder and the piston cylinder head.

The size and length of the scavenge passages 86 are predetermined and designed to effect greater or lesser force into the scavenge passages 86 to provide sufficient fresh mixture at a predetermined location within the lower chamber 62 to insure ignition on every stroke. The scavenge passages 86 are also designed and sized to effect the flow of a large percentage of the fuel-air mixture 30 from the intermediate chamber 72 to the lower chamber 62. Appropriate scavenge passage configurations provide delivery of a desired amount or percentage of fuel-air mixture 30 to a predetermined location in the lower chamber 62. As illustrated in FIGS. 12–15, the scavenge passages 86 can be shaped to direct a fuel-air mixture 30 into a particular location within the lower chamber 62. As illustrated in FIGS. 15 and 16, the piston cylinder head 32 can also be shaped to direct a fuel-air mixture 30 into a particular location within the lower chamber 62.

At the top of the piston cycle; all of the scavenge passages 86 are closed by the piston cylinder head 32, thereby preventing the communication of fluids between the intermediate chamber 72 and the lower chamber 62.

In embodiments wherein the apparatus 10 is to be used in a two-stroke cycle engine 11, the apparatus 10 further comprises an igniter 92 disposed proximate to the lower chamber 62 for igniting fluids within the lower chamber 62. Typically, such igniter 92 is provided by an ordinary spark plug. In one embodiment, the igniter 92 is positioned centrally, so as to minimize the combustion period, and to thereby improve combustion.

FIGS. 17–21 illustrate an alternative embodiment wherein the igniter 92 is mounted vertically in the piston cylinder head 32. This embodiment also illustrates an alternative method of mounting the piston cylinder head 32 into the piston cylinder 14 using a piston cylinder head collar 93 having its own cooling fins 44. In this embodiment, the electrodes of the igniter are disposed in the lower chamber 62 and its upper portion is disposed within a longitudinally disposed tube 94 running through the piston top wall 68 and secured at the piston cylinder head 32. The tube 94 serves as an access for the spark plug. This embodiment provides excellent mixture combustion by virtue of the central location of the spark plug. Since the volume occupied by the tube 94 effectively reduces the volume of the piston cylinder upper portion 16, the diameter of the piston cylinder upper portion 16 may be increased, as shown, to compensate for such loss in volume.

As illustrated in FIGS. 22–26, a plurality of axially oriented vertical seal strips 96 can be mounted in longitudinally-extending, circumferentially-spaced seal strip slots 98 in the interior surface 24 of the piston cylinder side wall 22. The vertical seal, strips 96 are disposed in the piston cylinder 14 to seal both sides of each upright extension member 66. Typically, the vertical seal strips 96 extend the length of the piston travel. In the embodiment illustrated in the drawings, the vertical seal strips 96 are also slidably disposed within vertical piston slots 99 defined in the exterior side walls of the piston 13. By disposing the vertical seal strips 96 in the vertical piston grooves 99, the vertical seal strips 96 act to minimize rotational movement of the piston 13 within the piston cylinder 14.

Figure 23A:
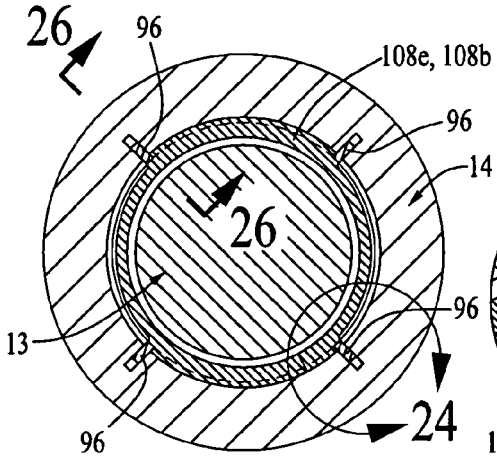
FIGS. 23A, 23B and 23C are cross-sectional views taken along lines 23A, 23B and 23C, respectively, in FIG. 3.
Figure 24:
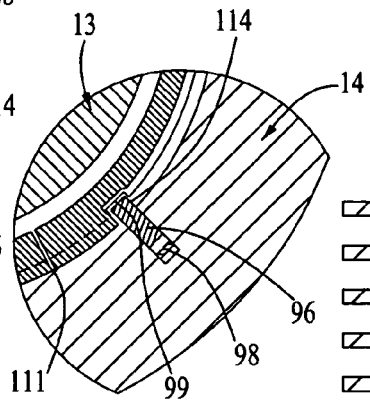
FIG. 24 is a cross-sectional view taken at line 24—24 in FIG. 23A.
Figure 23B:
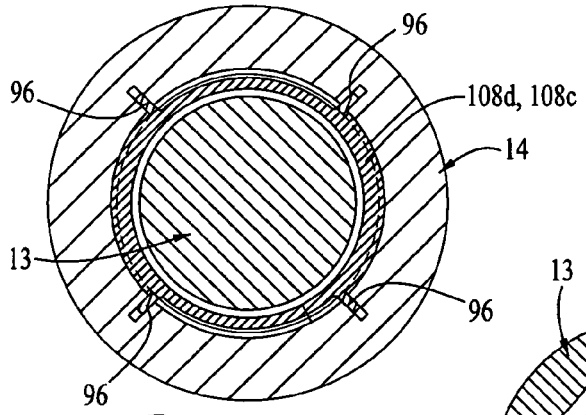
Figure 25:
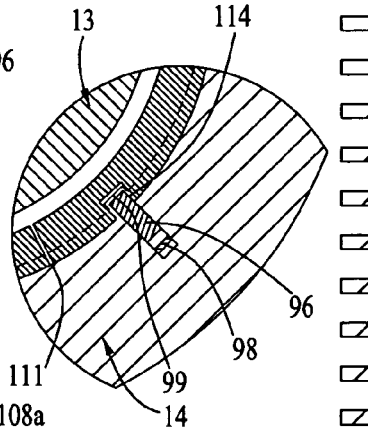
FIG. 25 is a cross-sectional view taken at circular arrow 25 in FIG. 23A.
Figure 23C:
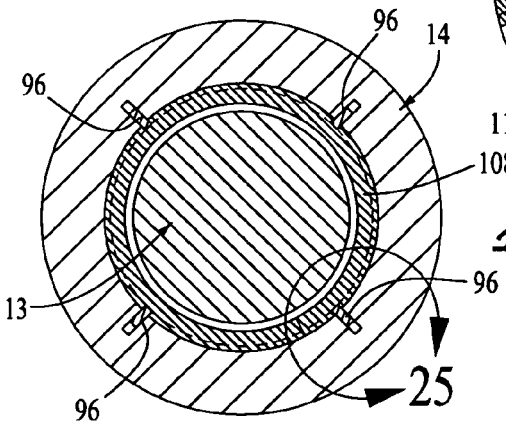
Figure 26:
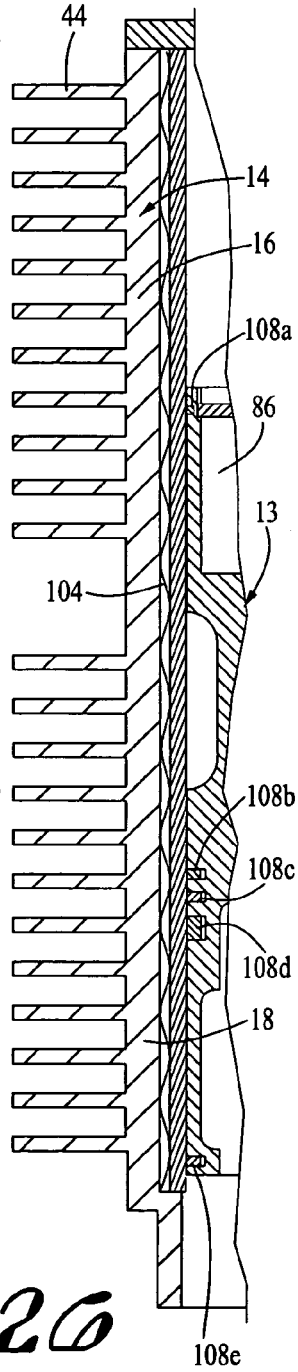
FIG. 26 is a partial cross-sectional view taken at circular arrow 26 in FIG. 23C.

The plurality of the vertical seal strips 96 are provided so as to define two diametrically opposed thrust quadrants 100 and two diametrically opposed exhaust quadrants 102 on the interior surface 24 of the cylinder wall. The thrust quadrants 100 are indicated in FIG. 23A and the exhaust quadrants 102 are indicated in FIG. 23B. The thrust quadrants 100 are substantially parallel to the crank shaft 46 and bear the pressure of converting the reciprocating motion of the piston 13 into the rotary motion of the crank shaft 46.

The vertical seal strips 96 serve four functions: gas sealing, dissipation on heat at the feather edge of the upright extension members 66, controlling oil on the piston cylinder interior surface 24 and the piston 13 and preventing rotation of the piston 13.

A lateral seal strip 106 is disposed on each side wall of the piston cylinder head 32 to seal the upright extension members 66 with the piston cylinder head 32. The respective ends on of the lateral seal strips 106 are each mated to edges of a vertical seal strip 96.

In the embodiments illustrated in the drawings, the seal strips 96 and 106 are urged radially towards the piston 13 by elongated, undulating, sine wave spring members 104 mounted in the seal strip slots 98.

A plurality of piston rings 108 are disposed in annular grooves 109 in the lower portion 59 of the piston 13 to provide effective sealing between the piston 13 and the cylinder wall 22. In the embodiment illustrated in the drawings, five piston rings 108 are disposed in respective piston ring grooves 109 in the piston 13. A first piston ring 108*a* is mounted in a piston ring groove 109 in the upper end of the lower piston portion 59, and three piston rings 108, the second piston ring 108*b*, the third piston ring 108*c* and the fourth piston ring 108*d* are mounted in respective piston ring grooves 109 in a lower portion 59 of the piston 13. A fifth piston ring 108*e* is disposed in a piston ring groove 109 at the bottom of the lower piston portion 59.

The piston rings 108 are of conventional type, are oversized relative to the piston cylinder 14, and each have a gap 111, thus to exert constant radially outward spring pressure against the piston cylinder wall 22 to cause the piston ring 108 to fill any clearance gap between the piston 13 and the cylinder 14.

Each piston ring 108 has defined in its periphery two diametrically opposite thrust quadrants 110, and two diametrically opposed exhaust quadrants 112. These quadrants correspond to the quadrants defined by the seal strips 96. Some of the quadrants 110 or 112 of the piston rings 108, except for the first piston ring 108*a*, have peripheral portions reduced in diameter, as by being ground down, as indicated in FIGS. 23A and 23B. The reduced edges of the quadrants of respective piston rings 108 enable the passage of oil upwardly on the cylinder wall 22, to provide lubrication between the cylinder wall 22 and the piston 13.

The piston rings 108 are adapted to enable lubrication of upper portions of the piston 13, and are so arranged and configured that oil may pass via the upright extension members 66, thus to lubricate the upper piston cylinder wall 22 and adjacent components. Oil can pass upwardly on the piston cylinder wall 22 to lubricate the upright extension members 66 relative to the piston cylinder wall 22 while these same rings seal the lower chamber 62.

Notches 114 in the respective piston rings 108 align with the vertical seal strips 96 to prevent contact between the piston rings 108 and the vertical seal strips 96. The notches 114 in the piston rings 108 serve the additional purpose in preventing piston ring rotation.

The first piston ring 108*a* serves as a compression ring. This first piston ring 108*a* has a uniform, full diameter. This piston ring 108*a* operates to prevent oil from reaching the upper chamber 70 and provides a compression seal for the intermediate chamber 72.

The second piston ring 108*b* also provides the function of a compression ring. This second piston ring 108*b* has a reduced diameter at its thrust quadrants 110. The purpose of this ring 108*b* is to allow oil to move up the cylinder 14 on the thrust quadrants 100 and to lubricate the piston upright extension members 66. This piston ring 108 also helps to seal the lower chamber 62.

The third piston ring 108*c* acts as an oil scraper. The third piston ring 108*c* has thrust quadrants 110 of reduced diameter to allow oil to move up the cylinder wall 22 via the thrust quadrants 110 to lubricate the upright extension members 66 and the cylinder wall 22.

The fourth piston ring 108*d* operates as an oil control piston ring 108. The fourth piston ring 108*d* has a reduced diameter at its exhaust quadrants 112. This ring 108 helps to control oil delivery on the thrust quadrants 100 and to minimize oil to the exhaust quadrants 102.

The fifth piston ring 108*e* acts as an oil scraper. This lowermost piston ring 108*e* has a reduced diameter at its thrust quadrants 110. This piston ring 108*e* acts to scrape oil from the exhaust quadrants 102 and to allow oil to move up the thrust side 110 of the cylinder 14.

In operation, the two-stroke cycle engine 11 illustrated in FIGS. 1–6 operates as follows. When the piston 13 reaches its lowest point at the end of a cycle, the inertial valve 74 is closed, some scavenge passages 86 may be closed, and the exhaust port 28 is open. The upper chamber 70 is maximized in size and is filled with fresh fuel-air mixture 30. The intermediate chamber 72 is minimized in size and is filled with residual fuel-air mixture 30 from the just ended piston cycle. The lower chamber 62 is maximized in size and is filled with two sets of gases. At the bottom of the lower chamber 62 is exhaust from the just ended piston cycle, and in the upper portion of the lower chamber 62 is fresh fuel-air mixture 30 which previously resided within the intermediate chamber 72. The exhaust port 28 is open and the exhaust within the lower portion of the lower chamber 62 is pressured out of the lower chamber 62 by the fresh fuel-air mixture 30 in the upper portion of the lower chamber 62. The apparatus 10 is configured so that, just before the fresh fuel-air mixture 30 within the lower chamber 62 reaches the exhaust port 28, the piston 13 starts its upward cycle and the exterior surface of the lower piston portion 59 moves upwardly to cover the exhaust port 28.

After the piston 13 begins its upward movement, the inertial valve 74 is opened. Fresh fuel-air mixture 30 flows from the upper chamber 70 to the intermediate chamber 72 as the piston top wall 68 begins contracting the upper chamber 70 and expanding the intermediate chamber 72. The scavenge passages 86 are momentarily opened and then closed again to seal closed the lower chamber 62. As the piston 13 continues thereafter to move upwardly, fresh fuel-air mixture 30 within the lower chamber 62 becomes compressed.

As the piston 13 passes its uppermost position and begins its downward cycle, the inertial valve 74 is closed and the upper chamber 70 is minimized in size. The intermediate chamber 72 is maximized in size and is filled with fresh fuel-air mixture 30. The scavenge passages 86 are closed. The lower chamber 62 is minimized in size and is filled with compressed fuel-air mixture 30.

Just prior to this point, the igniter 92 fires, exploding the compressed fuel-air mixture 30 within the lower chamber 62, and thereby driving the piston 13 downwardly.

As the piston 13 proceeds downwardly, the inertial valve 74 remains closed. The upper chamber 70 expands, drawing fresh fuel-air mixture 30 into the upper chamber 70. The intermediate chamber 72 contracts and the fresh fuel-air mixture 30 within the intermediate chamber 72 becomes compressed. The lower chamber 62 is expanding and is filled with exhaust.

As the piston 13 further continues downwardly, the exhaust port 28 opens the scavenge passages 86 open and the fresh fuel-air mixture 30 within the intermediate chamber 72 is pressured into the upper portion of the lower chamber 62. The flow of the fresh fuel-air mixture 30 from the intermediate chamber 72 into the upper portion of the lower chamber 62 pressurizes exhaust within the lower chamber 62 downwardly.

Thereafter, some of the scavenge passages 86 are closed as the piston 13 nears its lowest point. After the piston 13 reaches its lowest point, a new piston cycle begins.

As noted above, the apparatus 10 can be also be effectively used in a pump 12. Many different pump 12 configurations are possible. FIGS. 27 and 28 illustrate just two of them. In FIG. 27, all three of the chambers 62, 70 and 72 are used to pump 12 a fluid, such as a liquid. The apparatus 10 is similar to those previously described. In the embodiment illustrated in FIG. 27, however, the upper chamber 70 is in alternative communication with an upper portion intake port 116 and an upper portion discharge port 118. Also, both the intermediate chamber 72 and the lower chamber are in alternative communication with an intermediate portion intake port 120 and an intermediate portion discharge port 122.

An upper chamber intake valve 124 is provided for allowing fluids into the upper chamber 70 through the upper portion intake port 116 during the downward cycle of the piston 13, and for preventing fluids from flowing out of the upper chamber 70 through the upper portion intake port 116 during the upward cycle of the piston 13.

An intermediate chamber intake valve 126 is provided for allowing fluids into the intermediate chamber 72 through the intermediate portion intake port 120 during the upward cycle of the piston 13 and for preventing fluids from flowing out of the intermediate chamber 72 through the intermediate portion intake port 120 during the downward cycle of the piston.

A lower chamber intake valve 128 is provided for allowing fluids into the lower chamber 62 through the intermediate portion intake port 120 during the downward cycle of the piston 13 and for preventing fluids from flowing out of the lower chamber 62 through the intermediate portion intake port 120 during the upward cycle of the piston 13.

An upper chamber discharge valve 130 is provided for allowing fluids to flow out of the upper chamber 70 through the upper portion discharge port 118 during the upward cycle of the piston 13 and for preventing fluids from flowing into the upper chamber 70 through the upper portion discharge port 118 during the downward cycle of the piston 13.

An intermediate chamber discharge valve 132 is provided for allowing fluids to flow out of the intermediate chamber 72 through the intermediate portion discharge port 122 during the downward cycle of the piston 13 and for preventing fluids from flowing into the intermediate chamber 72 through the intermediate portion discharge port 122 during the upward cycle of the piston 13.

Finally, a lower chamber discharge valve 134 is provided for allowing fluids to flow out of the lower chamber 62 through the intermediate portion discharge port 122 during the upward cycle of the piston 13 and flow preventing fluids from flowing into the lower chamber 62 through the intermediate portion discharge port 122 during the downward cycle of the piston 13.

FIG. 28 illustrates a second pump 12 configuration. The embodiment illustrated in FIG. 28 uses the upper chamber 70 to pump 12 fluids, such as air, and the intermediate and lower chambers are used in a two-stroke cycle engine 11 to drive the pump 12.

The upper portion of the piston cylinder 14 defines an upper portion intake port 116 and an upper portion discharge port 118. The lower portion 18 of the piston cylinder 14 defines an exhaust port 28 (not shown in FIG. 28).

An upper chamber intake valve 124 is provided for allowing fluids into the upper chamber 70 through the upper portion intake port 116 during the downward cycle of the piston 13 and for preventing fluids from flowing out of the upper chamber 70 through the upper portion intake port 116 during the upward cycle of the piston 13.

An upper chamber discharge valve 130 is provided for allowing fluids to flow out of the upper chamber 70 through the upper chamber discharge port 118 during the upward cycle of the piston 13 and for preventing fluids from flowing into the upper chamber 70 through the upper portion discharge port 118 during the downward cycle of the piston 13.

A valve 74 is provided for alternatively allowing the transfer of fluids into the intermediate chamber 72 and for alternatively preventing the transfer of fluids from the intermediate chamber 72. In the embodiment illustrated in FIG. 28, such a valve 74 is provided by a flap or reed valve 74. In other embodiments, the flap or reed valve 74 could be replaced by an internal inertial valve 74 disposed within the top wall 68 of the piston 13.

Means 76 are also provided for alternatively allowing the transfer of fluids between the intermediate chamber 72 and the lower chamber 62 and for alternatively preventing the transfer of fluids between the intermediate chamber 72 and the lower chamber 62. In the embodiment illustrated in FIG.

28, such means 76 are provided by scavenge passages 86 in the upright extension members 66, as described with respect to the embodiments illustrated in FIGS. 1–9 and 12–26.

Finally, an igniter 92 is provided proximate to the lower chamber 62 for igniting fluids within the lower chamber 62.

As illustrated in FIG. 28, the upper chamber discharge port 118 can be connected to the exhaust port 28 to provide a combined air and exhaust mixture. In other embodiments, the upper chamber discharge port 118 can be maintained separate from the exhaust port 28.

The invention provides an inexpensive, efficient and effective way of solving the prior art problem with two-stroke cycle engines of the intake fuel-air mixture follow the exhaust out of the exhaust port. In the invention, this problem is solved by introducing the fuel-air mixture at the top of the combustion chamber. In this way, the mixture must travel down the cylinder filling the combustion chamber prior to reaching the exhaust port. By controlling the amount of mixture inducted, the piston will be in upward motion, closing the exhaust port before any mixture escapes.

The invention also provides a simple, efficient and inexpensive way of solving the problem with prior art two-stroke cycle engines of lubricating oil passing to the exhaust port. In the invention, this problem is solved by a quadrant system of rings and seals and locating the exhaust port on the non-thrust quadrant. The long seals in the cylinder isolate the quadrants and the rings limit the oil to the non-thrust quadrants. This is not detrimental to engine operation as piston load on these quadrants is minimal.

The invention also provides a simple, efficient and inexpensive solution to the problem in prior art two-stroke cycle engines of bringing intake fuel-air mixture from the bottom of the engine to the top of the cylinder where the igniter is located. In the invention, this problem is solved by a scavenge chamber of higher pressure capability delivering intake mixture directly to the top of the combustion chamber. Shaping and directing the delivery passages will ensure combustible mixture at the igniter even at very small throttle openings.

The invention also provides a simple, efficient and inexpensive solution to the problem in prior art two-stroke cycle engines of the difficulty of lubricating the cylinder walls. In the invention, this problem is solved by continuous oil supply to the thrust quadrants. These quadrants are not exposed to the heat of combustion, as the piston uprights cover these quadrants during engine operation. There are no port openings in these quadrants, so oil may flow freely upward between the cylinder wall and piston.

The invention also provides a simple, efficient and inexpensive solution to the problem in prior art two-stroke cycle engines of the use of the crank case as the delivery pump for the scavenge charge. In the invention, this problem is solved by the intermediate chamber. This chamber delivers intake mixture directly to the combustion chamber with potential pressures many times greater than a crank case pump. Additionally, this leaves the crank case available to serve as an oil sump, avoids the mixing of oil with the fuel and permits the use of inexpensive plain bearings.

Having thus described the invention, it should be apparent that numerous structural modifications and adaptations may be resorted to without departing from the scope and fair meaning of the instant invention as set forth hereinabove.

What is claimed is:

1. An apparatus useful in a two-stroke cycle engine or a pump, the apparatus comprising:

(a) a piston cylinder having a piston cylinder upper portion, a piston cylinder lower portion, a piston cylinder side wall with an interior surface and a piston cylinder top cover, the piston cylinder further having an intake port defined within the piston cylinder upper portion and an exhaust port defined within the piston cylinder lower portion;

(b) an intermediate piston cylinder head fixedly disposed within the piston cylinder so as to separate the piston cylinder upper portion from the piston cylinder lower portion, the piston cylinder head extending transversely across the interior of the piston cylinder and having an upper surface and a lower surface, the piston cylinder head being disposed within the piston cylinder so as to define at least one head gap between the interior surface of the piston cylinder side wall and the piston cylinder head;

(c) a piston slidably disposed within the piston cylinder, the piston having a piston side wall with an exterior surface, the piston being sized and dimensioned to be operatively sealable with the internal piston cylinder side wall, the piston also having a lower piston portion with a lower piston portion upper surface disposed within the lower piston and an upper piston portion comprising at least one upright extension member, the at least one upright extension member having an uppermost portion, the at least one upright extension member extending upwardly from the lower piston portion through the at least one head gap and being extendable upwardly into the upper cylinder portion, the lower piston portion upper surface being adapted to cooperate with the interior surface of the piston cylinder side wall, the at least one upright extension member and the lower surface of the piston cylinder head to define an enclosed lower chamber, the piston being operatively connected to a crank shaft by a piston rod and adapted to reciprocate within the piston cylinder between an upward cycle and a downward cycle;

(d) a piston top wall disposed transversely within the piston cylinder and attached to the uppermost portion of the at least one upright extension member, the piston top wall being adapted to cooperate with the interior surface of the piston cylinder side wall to define an enclosed upper chamber in the upper cylinder portion immediately above the piston top wall, the piston top wall also being adapted to cooperate with the at least one upright extension member, the interior surface of the piston cylinder side wall and the upper surface of the piston cylinder head to define an enclosed intermediate chamber immediately below the piston top wall;

(e) a valve for alternatively allowing the transfer of fluids into the intermediate chamber and for alternatively preventing the transfer of fluids from the intermediate chamber; and (f) means for alternatively allowing the transfer of fluids between the intermediate chamber and the lower chamber and for alternatively preventing the transfer of fluids between the intermediate chamber and the lower chamber.

2. The apparatus of claim 1 further comprising an igniter disposed proximate to the lower chamber for igniting fluids within the lower chamber.

3. The apparatus of claim 1, wherein the intermediate piston cylinder head is disposed within the piston cylinder so as to define a pair of opposed head gaps between the interior surface of the piston cylinder side wall and the piston cylinder head, wherein the at least one upright extension member comprises a pair of opposed upright extension members, and wherein each of the pair of opposed upright extension members extends upwardly from the lower piston portion through one of the two opposed head gaps and is extendable upwardly into the upper piston cylinder portion.

4. The apparatus of claim 1 further comprising an igniter disposed proximate to the lower chamber for igniting fluids within the lower chamber, wherein the intermediate piston cylinder head is disposed within the piston cylinder so as to define a pair of opposed head gaps between the interior surface of the piston cylinder side wall and the piston cylinder head, wherein the at least one upright extension member comprises a pair of opposed upright extension members, and wherein each of the pair of opposed upright extension members extends upwardly from the lower piston portion through one of the two opposed head gaps and is extendable upwardly into the upper piston cylinder portion.

5. The apparatus of claim 1, wherein the valve is an electro-mechanical valve disposed external of the piston cylinder.

6. The apparatus of claim 1, wherein the valve is a flap or reed valve.

7. The apparatus of claim 1, wherein the apparatus is operatively disposed within a two-stroke cycle engine.

8. The apparatus of claim 1, wherein the apparatus is operatively disposed within a pump.

9. An apparatus useful in a two-stroke cycle engine, the apparatus comprising:

(a) a piston cylinder having a piston cylinder upper portion, a piston cylinder lower portion, a piston cylinder side wall with an interior surface and a piston cylinder top cover, the piston cylinder further having an intake port defined within the piston cylinder upper portion and an exhaust port defined within the piston cylinder lower portion;

(b) an intermediate piston cylinder head fixedly disposed within the piston cylinder so as to separate the piston cylinder upper portion from the piston cylinder lower portion, the piston cylinder head extending transversely across the interior of the piston cylinder and having an upper surface and a lower surface, the piston cylinder head being disposed within the piston cylinder so as to define at least one head gap between the interior surface of the piston cylinder side wall and the piston cylinder head;

(c) a piston slidably disposed within the piston cylinder, the piston having a piston side wall with an exterior surface, the piston being sized and dimensioned to be operatively sealable with the interior surface of the piston cylinder side wall, the piston also having a lower piston portion with a lower piston portion upper surface disposed within the lower piston cylinder portion and an upper piston portion comprising at least one upright extension member, the at least one upright extension member having an uppermost portion, the at least one upright extension member extending upwardly from the lower piston portion through the at least one head gap and being extendable upwardly into the upper cylinder portion, the lower piston portion upper surface being adapted to cooperate with the interior surface of the piston cylinder side wall, the at least one upright extension member and the lower surface of the piston cylinder head to define an enclosed lower chamber, the piston being operatively connected to a crank shaft by a piston rod and adapted to reciprocate within the piston cylinder between an upward cycle and a downward cycle;

(d) a piston top wall disposed transversely within the piston cylinder and attached to the uppermost portion of the at least one upright extension member, the piston top wall being adapted to cooperate with the interior surface of the piston cylinder side wall to define an enclosed upper chamber in the upper cylinder portion immediately above the piston top wall, the piston top wall also being adapted to cooperate with the at least one upright extension member, the interior surface of the piston cylinder side wall and the upper surface of the piston cylinder head to define an enclosed intermediate chamber immediately below the piston top wall;

(e) a valve for alternatively allowing the transfer of fluids between the upper chamber and the intermediate chamber and for alternatively preventing the transfer of fluids between the upper chamber and the intermediate chamber;

(f) means for alternatively allowing the transfer of fluids between the intermediate chamber and the lower chamber and for alternatively preventing the transfer of fluids between the intermediate chamber and the lower chamber; and (g) an igniter disposed proximate to the lower chamber for igniting fluids within the lower chamber.

10. An apparatus useful in a two-stroke cycle engine, the apparatus comprising:

(a) a piston cylinder having a piston cylinder upper portion, a piston cylinder lower portion, a piston cylinder side wall with an interior surface and a piston cylinder top cover, the piston cylinder further having an intake port defined within the piston cylinder upper portion and an exhaust port defined within the piston cylinder lower portion;

(b) an intermediate piston cylinder head fixedly disposed within the piston cylinder so as to separate the piston cylinder upper portion from the piston cylinder lower portion, the piston cylinder head extending transversely across the interior of the piston cylinder and having an upper surface and a lower surface, the piston cylinder head being disposed within the piston cylinder so as to define a pair of opposed head gaps between the interior surface of the piston cylinder side wall and the piston cylinder head;

(c) a piston slidably disposed within the piston cylinder, the piston having a piston side wall with an exterior surface, the piston being sized and dimensioned to be operatively sealable with the interior surface of the piston cylinder side wall, the piston also having a lower piston portion with a lower piston portion upper surface disposed within the lower piston cylinder portion and an upper piston portion comprising a pair of opposed upright extension members, both having an uppermost portion, each of the pair of opposed upright extension members extending upwardly from the lower piston portion through one of the two opposed head gaps and being extendable upwardly into the upper cylinder portion, the lower piston portion upper surface being adapted to cooperate with the interior surface of the piston cylinder side wall, the upright extension members and the lower surface of the piston cylinder head to define an enclosed lower chamber, the piston being operatively connected to a crank shaft by a piston rod, and adapted to reciprocate within the piston cylinder between an upward cycle and a downward cycle;

(d) a piston top wall disposed transversely within the piston cylinder side wall and attached to each of the uppermost portions of the pair of upright extension members, the piston top wall being disposed to cooperate with the interior surface of the piston cylinder side wall to define an enclosed upper chamber in the upper cylinder portion immediately above the piston top wall, the piston top wall also being adapted to cooperate with the pair of upright extension members, the interior surface of the piston cylinder side wall and the upper surface of the piston cylinder head to define an enclosed intermediate chamber immediately below the piston top wall;

(e) a valve for alternatively allowing the transfer of fluids between the upper chamber and the intermediate chamber and for alternatively preventing the transfer of fluids between the upper chamber and the intermediate chamber;

(f) means for alternatively allowing the transfer of fluids between the intermediate chamber and the lower chamber and for alternatively preventing the transfer of fluids between the intermediate chamber and the lower chamber; and (g) an igniter disposed proximate to the lower chamber for igniting fluids within the lower chamber.

11. The apparatus of claim 10, wherein the valve is an inertial valve disposed within the piston top wall and adapted to open on the downward cycle of the piston and to close on the upward cycle of the piston.

12. The apparatus of claim 10, wherein the means for alternatively allowing the transfer of fluids between the intermediate chamber and the lower chamber is a valve.

13. The apparatus of claim 10, wherein the means for alternatively allowing the transfer of fluids between the intermediate chamber and the lower chamber comprises at least one scavenge passage disposed within each of the pair of upright extension members, the scavenge passages being in communication with the intermediate chamber on the upward cycle of the piston and in communication with the intermediate and lower chambers on the downward cycle of the piston.

14. The apparatus of claim 13, wherein each of the pair of upright extension members comprises a plurality of scavenge passages, at least one of the scavenge passages in each of the pair of upright extension members having a top wall and at least one of the scavenge passages in each of the pair of upright extension members not having a top wall.

15. The apparatus of claim 10, further comprising a plurality of spaced apart-vertical seal strips mounted in circumferentially-spaced slots in the interior surface of the cylinder wall.

16. The apparatus of claim 15 further comprising springs disposed in the slots to urge the respective vertical seal strips therein radially inward towards the piston.

17. The apparatus of claim 15 wherein the vertical seal strips are slidably disposed within vertical piston slots which are defined in the exterior wall of the piston.

18. The apparatus of claim 10, further comprising a lateral seal strip disposed on each side of the piston cylinder head.

19. The apparatus of claim 10 further comprising a plurality of piston rings disposed in a plurality of spaced apart grooves defined in the exterior surface of the piston, and wherein a plurality of the piston rings have reduced edge portions to enable passage of oil upwardly along the interior surface of the piston wall.

20. An apparatus useful in a pump, the apparatus comprising:

(a) a piston cylinder having a piston cylinder upper portion, a piston cylinder lower portion, a piston cylinder side wall with an internal surface and a piston cylinder top cover, the piston cylinder further having an upper portion intake port defined within the piston cylinder side wall, an intermediate portion intake port defined within the piston cylinder side wall, an upper portion discharge port defined within the piston cylinder side wall and an intermediate portion discharge port defined within the piston cylinder side wall;

(b) an intermediate piston cylinder head fixedly disposed within the piston cylinder so as to separate the piston cylinder upper portion from the piston cylinder lower portion, the piston cylinder head extending transversely across the interior of the piston cylinder and having an upper surface and a lower surface, the piston cylinder head being disposed within the piston cylinder so as to define at least one head gap between the interior surface of the piston cylinder side wall and the piston cylinder head;

(c) a piston slidably disposed within the piston cylinder, the piston having a piston side wall with an exterior surface, the piston being sized and dimensioned to be operatively sealable with the piston cylinder, the piston also having a lower piston portion with a lower piston portion upper surface disposed within the lower piston cylinder portion and an upper piston portion comprising at least one upright extension member, the at least one upright extension member having an uppermost portion, the at least one upright extension member extending upwardly from the lower piston portion through the at least one head gap and being extendable upwardly into the upper cylinder portion, the lower piston portion upper surface being adapted to cooperate with the interior surface of the piston cylinder side wall, the at least one upright extension member and the lower surface of the piston cylinder head to define an enclosed lower chamber, the piston being operatively connected to a crank shaft by a piston rod and adapted to reciprocate within the piston cylinder between an upward cycle and a downward cycle;

(d) a piston top wall disposed transversely to the piston cylinder and attached to the uppermost portion of the at least one upright extension member, the piston top wall being adapted to cooperate with the interior surface of the piston cylinder side wall to define an enclosed upper chamber in the upper cylinder portion immediately above the piston top wall, the piston top wall also being adapted to cooperate with the at least one upright extension member, the interior surface of the piston cylinder side wall and the upper surface of the piston cylinder head to define an enclosed intermediate chamber immediately below the piston top wall;

(e) an upper chamber intake valve for allowing fluids into the upper chamber through the upper portion intake port during the downward cycle of the piston and for preventing fluids from flowing out of the upper chamber through the upper portion intake port during the upward cycle of the piston;

(f) an intermediate chamber intake valve for allowing fluids into the intermediate chamber through the intermediate portion intake port during the upward cycle of the piston and for preventing fluids from flowing out of the intermediate chamber through the intermediate portion intake port during the downward cycle of the piston;

(g) a lower chamber intake valve for allowing fluids into the lower chamber through the intermediate portion intake port during the downward cycle of the piston and for preventing fluids from flowing out of the lower chamber through the intermediate portion intake port during the upward cycle of the piston;

(h) an upper portion discharge valve for allowing fluids to flow out of the upper chamber through the upper portion discharge port during the upward cycle of the piston and for preventing fluids from flowing into the upper chamber through the upper portion discharge port during the downward cycle of the piston;

(i) an intermediate chamber discharge valve for allowing fluids to flow out of the intermediate chamber through the intermediate portion discharge port during the downward cycle of the piston and for preventing fluids from flowing into the intermediate chamber through the intermediate portion discharge port during the upward cycle of the piston; and (j) a lower chamber discharge valve for allowing fluids to flow out of the lower chamber through the intermediate portion discharge port during the upward cycle of the piston and for preventing fluids from flowing into the lower chamber through the intermediate portion discharge port during the downward cycle of the piston.

21. An apparatus useful in a pump, the apparatus comprising:

(a) a piston cylinder having a piston cylinder upper portion, a piston cylinder lower portion, a piston cylinder side wall with an internal surface and a piston cylinder top cover, the piston cylinder further having an upper portion intake port defined within the piston cylinder side wall, an upper portion discharge port defined within the piston cylinder side wall and an exhaust port defined within the piston cylinder lower portion;

(b) an intermediate piston cylinder head fixedly disposed within the piston cylinder so as to separate the piston cylinder upper portion from the piston cylinder lower portion, the piston cylinder head extending transversely across the interior of the piston cylinder and having an upper surface and a lower surface, the piston cylinder head being disposed within the piston cylinder so as to define at least one head gap between the interior surface of the piston cylinder side wall and the piston cylinder head;

(c) a piston slidably disposed within the piston cylinder, the piston having a piston side wall with an exterior surface, the piston being sized and dimensioned to be operatively sealable with the piston cylinder, the piston also having a lower piston portion with a lower piston portion upper surface disposed within the lower piston cylinder portion and an upper piston portion comprising at least one upright extension member, the at least one upright extension member having an uppermost portion, the at least one upright extension member extending upwardly from the lower piston portion through the at least one head gap and being extendable upwardly into the upper cylinder portion, the lower piston portion upper surface being adapted to cooperate with the interior surface of the piston cylinder side wall, the at least one upright extension member and the lower surface of the piston cylinder head to define an enclosed lower chamber, the piston being operatively connected to a crank shaft by a piston rod and adapted to reciprocate within the piston cylinder between an upward cycle and a downward cycle;

(d) a piston top wall disposed transversely to the piston cylinder and attached to the uppermost portion of the at least one upright extension member, the piston top wall being adapted to cooperate with the interior surface of the piston cylinder side wall to define an enclosed upper chamber in the upper cylinder portion immediately above the piston top wall, the piston top wall also being adapted to cooperate with the at least one upright extension member, the interior surface of the piston cylinder side wall and the upper surface of the piston cylinder head to define an enclosed intermediate chamber immediately below the piston top wall;

(e) an upper chamber intake valve for allowing fluids into the upper chamber through the upper portion intake port during the downward cycle of the piston and for preventing fluids from flowing out of the upper chamber through the upper portion intake port during the upward cycle of the piston;

(f) a valve for alternatively allowing the transfer of fluids into the intermediate chamber and for alternatively preventing the transfer of fluids from the intermediate chamber;

(g) means for alternatively allowing the transfer of fluids between the intermediate chamber and the lower chamber and for alternatively preventing the transfer of fluids between the intermediate chamber and the lower chamber;

(h) means for alternatively allowing the transfer of fluids between the intermediate chamber and the lower chamber and for alternatively preventing the transfer of fluids between the intermediate chamber and the lower chamber; and (i) an igniter disposed proximate to the lower chamber for igniting fluids within the lower chamber.

* * * * *